US007585061B2

(12) United States Patent
Mita

(10) Patent No.: US 7,585,061 B2
(45) Date of Patent: Sep. 8, 2009

(54) EJECTION HEAD AND IMAGE FORMING APPARATUS

(75) Inventor: Tsuyoshi Mita, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 397 days.

(21) Appl. No.: 11/210,897

(22) Filed: Aug. 25, 2005

(65) Prior Publication Data

US 2006/0044358 A1 Mar. 2, 2006

(30) Foreign Application Priority Data

Aug. 27, 2004 (JP) ..... 2004-248652

(51) Int. Cl.
*B41J 2/045* (2006.01)

(52) U.S. Cl. ..... 347/70; 347/68

(58) Field of Classification Search ..... 347/68–72
See application file for complete search history.

(56) References Cited

U.S. PATENT DOCUMENTS

| | | | | |
|---|---|---|---|---|
| 6,334,672 | B1 * | 1/2002 | Matsui et al. | 347/70 |
| 6,350,019 | B1 | 2/2002 | Shingai et al. | |
| 6,402,971 | B2 | 6/2002 | Hashizume et al. | |
| 6,471,341 | B1 * | 10/2002 | Yoshimura et al. | 347/70 |
| 6,584,660 | B1 * | 7/2003 | Shimogawa et al. | 29/25.35 |
| 6,609,785 | B2 | 8/2003 | Hashizume et al. | |
| 7,270,404 | B2 * | 9/2007 | Mita | 347/68 |
| 2001/0001458 | A1 | 5/2001 | Hashizume et al. | |
| 2002/0071008 | A1 | 6/2002 | Hashizume et al. | |
| 2002/0196314 | A1 * | 12/2002 | Greiser et al. | 347/68 |
| 2004/0001123 | A1 * | 1/2004 | Yamaguchi | 347/70 |
| 2004/0085409 | A1 | 5/2004 | Hashizume et al. | |

FOREIGN PATENT DOCUMENTS

| | | | |
|---|---|---|---|
| EP | 0 670 218 | A2 | 2/1995 |
| EP | 1 031 422 | A2 | 2/1995 |
| EP | 1520701 | A1 * | 4/2005 |

(Continued)

OTHER PUBLICATIONS

Mark's Standard Handbook for Mechanical Engineers, 10th ed. New York, McGraw-Hill, 1996. pp. 5-4, 6-188, and 6-189. TJ151.S82 1996.*

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

The ejection head includes a wall member which forms a pressure chamber and has an ejection aperture through which droplets of a liquid are ejected onto an ejection receiving medium, the pressure chamber accommodating the liquid to be ejected from the ejection aperture; a diaphragm which causes a volume of the pressure chamber to change by performing bending deformation so as to cause the liquid accommodated in the pressure chamber to be ejected from the ejection aperture, the diaphragm forming one face of the pressure chamber; a piezoelectric element which causes the diaphragm to perform bending deformation in accordance with a drive signal, the piezoelectric element being disposed on the diaphragm; and a bonding member which bonds the diaphragm with the wall member, wherein the bonding member comprises a low-rigidity member; and the piezoelectric element has a greater length than an internal effective length of the pressure chamber.

23 Claims, 17 Drawing Sheets

FOREIGN PATENT DOCUMENTS

| | | | |
|---|---|---|---|
| JP | 5-246024 | A | 9/1993 |
| JP | 7-290705 | A | 11/1995 |
| JP | 2001-26106 | A | 1/2001 |
| JP | 2003-25573 | A | 1/2003 |
| JP | 2004-66652 | A | 3/2004 |
| JP | 2004-74806 | A | 3/2004 |

* cited by examiner

FIG.12

| YOUNG'S MODULUS OF BONDING MEMBER (GPa) | NO DISPLACEMENT | | DISPLACEMENT (10 μm) | | EFFECTS OF DISPLACEMENT | |
|---|---|---|---|---|---|---|
| | DISPLACEMENT VOLUME | GENERATED FORCE | DISPLACEMENT VOLUME | GENERATED FORCE | DISPLACEMENT VOLUME | GENERATED FORCE |
| 0.01 | -46.61 | 1.12 | -46.41 | 1.13 | -0.44% | 0.47% |
| 1 | -18.14 | 1.94 | -17.97 | 1.91 | -0.94% | -1.37% |
| 200 | -13.53 | 2.48 | -13.38 | 2.44 | -1.12% | -1.60% |

UNIT OF DISPLACEMENT VOLUME: pl

UNIT OF GENERATED FORCE: MPa

EJECTION HEAD AND IMAGE FORMING APPARATUS

BACKGROUND OF THE INVENTION

1. Field of the Invention

The present invention relates to an ejection head and an image forming apparatus, and more particularly to a structure of an ejection head which ejects a liquid onto an ejection receiving medium.

2. Description of the Related Art

In recent years, inkjet printers have come to be used widely as data output apparatuses for outputting images, documents, or the like. By driving recording elements, such as nozzles provided in a recording head, in accordance with data, an inkjet printer is able to form data onto a recording medium such as recording paper, by means of ink ejected from the nozzles.

In an inkjet printer, a desired image is formed on a recording medium by causing a print head having a plurality of nozzles and a recording medium to move relatively to each other, while causing ink droplets to be ejected from the nozzles.

The method for causing the ink to be ejected from the print head provided in an inkjet printer may be a piezoelectric method in which actuators, such as piezoelectric elements, are provided on a diaphragm (pressure plate) which forms a wall of pressure chambers in which the ink is accommodated, the pressure chambers are caused to deform by driving the actuators, and a volume of ink corresponding to the amount of change in the volume of the pressure chambers is ejected, or it may be a thermal method in which ink inside pressure chambers is heated by heaters provided in the pressure chambers, and ink is ejected due to the pressure of the bubbles generated inside the pressure chambers when the ink is heated.

In the inkjet printer, in order to achieve high quality in the image formed on the recording medium, a print head having a high (stable) ejection characteristic is required. In a print head using a piezoelectric method, the ejection characteristics of the print head can be improved by raising the conversion efficiency of the actuators by adopting various designs in the structure and shape of the actuators or the pressure chambers accommodating the ink.

The inkjet head disclosed in Japanese Patent Application Publication No. 5-246024 adopts a structure in which a thin plate of electrostrictive material, which is difficult to machine, has a single-plate structure and is machined to a high level of accuracy by plating, etching, or the like, and an elastic thin plate divided into two parts is provided. Thereby, it is possible to reduce the cost of the apparatus as well as achieving high-quality printing.

In the inkjet head disclosed in Japanese Patent Application Publication No. 7-290705, an elastic member is used for wall members forming pressure chambers between a nozzle plate and a pressure plate, thereby increasing the efficiency of conversion from the force generated by the piezo element to the ink ejection force, and furthermore, increasing the durability of the head (improving the resistance to stress acting from the diaphragm to the pressure chambers), facilitating assembly (improving the margin of tolerance relating to positional divergence), and preventing satellite effects (namely, suppressing residual vibrations).

The inkjet head and inkjet printer disclosed in Japanese Patent Application Publication No. 2001-26106 have a structure in which the functional distortion index of a piezoelectric element is taken to be $550\times10^{-6}$ or more; the stress index is taken to be $30\times10^{6}$ or more; the electrical field intensity $3.0\times10^{6}$ or more; the width of the pressure chambers is taken to be no less than 220 μm and no more than 300 μm; the thickness bonding the piezoelectric element and the diaphragm is taken to be no less than 1.5 μm and no more than 30 μm; and the width of the pressure chambers is taken to be no less than 28 μm and no more than 330 μm. Thereby, it is possible to achieve printing characteristics providing good efficiency and satisfactory practicability.

The inkjet print head and piezoelectric converter disclosed in Japanese Patent Application Publication No. 2003-25573 have a structure in which the outer perimeter of a piezoelectric converter overlaps with the opening of a chamber. Thereby, the processing capacity of the piezoelectric converter is increased, the piezoelectric sensitivity is reduced, and manufacturing variation is also reduced.

In the liquid droplet ejection head, the ink cartridge, and the inkjet recording apparatus disclosed in Japanese Patent Application Publication No. 2004-66652, a diaphragm has a hinge structure forming a structural portion of partially reduced rigidity. Thereby, it is possible to achieve a high-density liquid ejection head which is little variations in ejection characteristics.

In the inkjet recording head and method for manufacturing same described in Japanese Patent Application Publication No. 2004-74806, upper electrodes and piezoelectric thin films are etched simultaneously. Thereby, since there is no divergence in pattern between the piezoelectric thin films and the electrodes, the electrical field is applied efficiently to the piezoelectric thin films so that satisfactory displacement can be obtained.

However, in a print head formed to a high density, the structure and shape of the actuators and pressure chambers are subject to dimensional restrictions, and these restrictions are even more severe in the case of a print head formed to particularly high density. In addition, when using a functional ink imparted with functional properties, such as smear preventing characteristics or fixing promoting characteristics, functional ink of this kind has higher viscosity than generally used inks, thereby requiring even better ejection characteristics.

In the inkjet head disclosed in Japanese Patent Application Publication No. 5-246024, since the electrostrictive thin plate makes contact directly with the ink, insulation processing should be applied to the electrostrictive thin plate. In addition, an electrostrictive thin plate disclosed in Japanese Patent Application Publication No. 5-246024 is difficult to manufacture. Furthermore, in Japanese Patent Application Publication No. 5-246024, there is no specific disclosure relating to regarding the displacement volume of the pressure chambers and the pressure generated by the electrostrictive thin plates, when the inkjet head is formed to a high density in order to achieve high-resolution printing.

The inkjet head disclosed in Japanese Patent Application Publication No. 7-290705 has a composition in which the volume of the pressure chambers is changed by deforming the wall members of the pressure chambers. Therefore, it is necessary for suppression of mutual interference between neighboring pressure chambers.

In the inkjet head and the inkjet printer disclosed in Japanese Patent Application Publication No. 2001-26106, the general shape of the print head comprising the pressure chambers, piezoelectric bodies, diaphragm, and the like, is stipulated. However, it is doubtful whether ejection characteristics can be made more efficient. In addition, there is no particular disclosure regarding variation within the print head.

In the inkjet-type print head and piezoelectric converter disclosed in Japanese Patent Application Publication No. 2003-25573, the object thereof is to suppress variation in the manufacture and assembly of piezoelectric converters, but there is no disclosure of technology for improving ejection characteristics. Additionally, when the amount of overlap between the chamber openings and the piezoelectric converters exceeds 5%, the volumetric displacement of the chambers declines, and therefore, it is necessary to install the piezoelectric converters on the chambers to a very high degree of accuracy.

In the liquid droplet ejection head, ink cartridge and inkjet recording apparatus disclosed in Japanese Patent Application Publication No. 2004-66652, when manufacturing the diaphragm having a hinge structure, the manufacturing process increases in complexity. In addition, variations in the quality of the manufactured hinge structure may have an influence on the ejection characteristics.

In the inkjet recording head and method of manufacturing same disclosed in Japanese Patent Application Publication No. 2004-74806, since the piezoelectric thin films and the electrodes are formed in the same shape, it is possible to obtain an effect in maximizing the pressure generated by the piezoelectric bodies. However, it is doubtful whether satisfactory displacement could be obtained when the viscosity (or other properties) of the ink to be ejected is changed.

SUMMARY OF THE INVENTION

The present invention is contrived in view of such circumstances, and an object thereof is to provide an ejection head and an image forming apparatus that can achieve satisfactory ejection even when using a high-viscosity liquid, without causing the ejection efficiency to decline, whereby can achieve higher density.

In order to attain the aforementioned object, the present invention is directed to an ejection head comprising: a wall member which forms a pressure chamber and has an ejection aperture through which droplets of a liquid are ejected onto an ejection receiving medium, the pressure chamber accommodating the liquid to be ejected from the ejection aperture; a diaphragm which causes a volume of the pressure chamber to change by performing bending deformation so as to cause the liquid accommodated in the pressure chamber to be ejected from the ejection aperture, the diaphragm forming one face of the pressure chamber; a piezoelectric element which causes the diaphragm to perform bending deformation in accordance with a drive signal, the piezoelectric element being disposed on the diaphragm; and a bonding member which bonds the diaphragm with the wall member, wherein the bonding member comprises a low-rigidity member; and the piezoelectric element has a greater length than an internal effective length of the pressure chamber.

According to the present invention, if the rigidity of the bonding member which bonds the diaphragm with the wall member forming the pressure chamber is reduced, then the bonding member contributes to the displacement of the diaphragm. Therefore, since the amount of displacement of the diaphragm can be increased, it is possible to increase the displacement volume of the pressure chamber. In addition, since the width of the piezoelectric element is greater than the width of the pressure chamber, it is possible to suppress reduction in the pressure generated by the piezoelectric element. Accordingly, it is possible to achieve satisfactory ejection even when adopting a liquid of higher viscosity than a generally used liquid (for example, a viscosity of liquid is 10 cP to 50 cP, where 1 cP=$1\times100^{-3}$ Pa·s)

Furthermore, since the wall members constituting the pressure chamber have a rigidity so as to prevent deformation thereof when the piezoelectric element is driven, it is possible to maintain the pressure generated by the piezoelectric element.

If a piezoelectric element distorting mainly in the $d_{31}$ direction is used as a piezoelectric element which distorts in a direction substantially perpendicular to the direction applying the voltage (electrical field) so as to distort the diaphragm in a bending mode, then it is possible to ensure a prescribed amount of distortion of the diaphragm even if applying at a low voltage.

As the piezoelectric element, it is suitable to use piezoelectric ceramic, such as lead zirconate titanate ($Pb(Zr, Ti)O_3$), or barium titanate ($BaTiO_3$), or the like. In addition, as the piezoelectric element, it is possible to use a single-layer piezoelectric element having one piezoelectric layer sandwiched between electrodes, or a laminated piezoelectric element in which a plurality of piezoelectric elements and electrodes are layered in alternating fashion.

Furthermore, the piezoelectric element may be a split electrode type of piezoelectric element in which each piezoelectric element has a plurality of individual electrodes, which can cause one piezoelectric element to function equivalently to a plurality of piezoelectric elements by controlling the respective individual electrodes. The regions which function as the split voltage type piezoelectric elements are the regions where the individual electrodes are disposed.

The ejection head may be a full line type ejection head in which ejection apertures for ejecting liquid droplets are arranged through a length corresponding to the entire width of the ejection receiving medium, or a serial type ejection head (shuttle scanning type ejection head) in which a short head having ejection apertures for ejecting liquid droplets arranged through a length that is shorter than the entire width of the ejection receiving medium ejects liquid droplets onto the ejection receiving medium while scanning in the width direction of the ejection receiving medium.

The full line ejection head may be formed to a length corresponding to the full width of the recording medium by combining short head having rows of ejection apertures which do not reach a length corresponding to the full width of the ejection receiving medium, these short heads being joined together in a staggered matrix fashion.

The liquid ejected from the ejection head may be an ink used in an inkjet recording apparatus, or a treatment liquid, chemical solution, water, or the like, ejected onto a medium by an application apparatus, such as a dispenser.

The present invention is also directed to the ejection head wherein the bonding member comprises an adhesive which bonds the wall member with the diaphragm.

According to the present invention, since an adhesive or an adhesive film is used as the bonding member, it is possible to simplify manufacture. In addition, the thickness of the bonding member depends on the Young's modulus of the bonding member, and the thickness increases, the lower the Young's modulus of the bonding member.

As the adhesive, an epoxy adhesive or a silicon type adhesive may be used. Also, it is suitable for using an adhesive film, such as P2, DFR, or the like.

The present invention is also directed to the ejection head wherein the bonding member comprises a member having a Young's modulus of no less than 1 MPa and no more than 1 GPa.

According to the present invention, in particular, when using a member having a Young's modulus of no less than 1 MPa and no more than 1 GPa, it is possible to achieve an increased displacement of the diaphragm and a suppression of reduction in the pressure generated by the piezoelectric element at a suitable bonding thickness.

Preferably, a member having a Young's modulus of no less than 1 MPa and no more than 100 MPa is used for the bonding member.

The present invention is also directed to the ejection head wherein the bonding member comprises a member having an anisotropic characteristic so that a rigidity of the member is low in a width direction of the bonding member.

According to the present invention, when a low-rigidity member is used for the bonding member, the intrinsic frequency of vibration of the pressure chamber is reduced, and hence the intrinsic frequency of vibration places a limitation on the ejection frequency. In addition, when the rigidity of the bonding member is high in the thickness direction and the rigidity is low in the width direction, it is possible to increase the displacement of the diaphragm without decreasing the intrinsic frequency of vibration of the pressure chamber.

The present invention is also directed to the ejection head further comprising a diaphragm plate which is divided by a groove structure into a plurality of regions, wherein the diaphragm corresponds to one of the regions.

According to the present invention, since the diaphragm is divided up so as to correspond with the respective pressure chambers, it is possible to suppress cross-talk generated between mutually adjacent pressure chambers.

In order to achieve the aforementioned object, the present invention is directed to an image forming apparatus comprising an ejection head which comprises: a wall member which forms a pressure chamber and has an ejection aperture through which droplets of a liquid are ejected onto an ejection receiving medium, the pressure chamber accommodating the liquid to be ejected from the ejection aperture; a diaphragm which causes a volume of the pressure chamber to change by performing bending deformation so as to cause the liquid accommodated in the pressure chamber to be ejected from the ejection aperture, the diaphragm forming one face of the pressure chamber; a piezoelectric element which causes the diaphragm to perform bending deformation in accordance with a drive signal, the piezoelectric element being disposed on the diaphragm; and a bonding member which bonds the diaphragm with the wall member, wherein the bonding member comprises a low-rigidity member; and the piezoelectric element has a greater length than an internal effective length of the pressure chamber.

Herein, the image forming apparatus may include an inkjet recording apparatus which forms a desired image on a recording medium (ejection receiving medium) by ejecting ink from nozzles (ejection apertures).

As described above, according to the present invention, a low-rigidity member is used for the bonding members which bonds the diaphragm with the pressure chamber, and the width of the piezoelectric element is made larger than the width of the face of the pressure chamber formed by the diaphragm, then the displacement of the diaphragm is increased. Therefore, it is possible to increase the displacement volume of the pressure chamber, and to suppress reduction in the pressure generated by the piezoelectric element. In addition, it is also possible to suppress variations in the pressure generated by the piezoelectric element due to manufacturing variations.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 12 is a table showing the displacement volume of pressure chamber and the pressure generated by the piezoelectric element, due to manufacturing variations;

DETAILED DESCRIPTION OF THE PREFERRED EMBODIMENTS

General Composition of Inkjet Recording Apparatus Including Print Head

Figure 1:
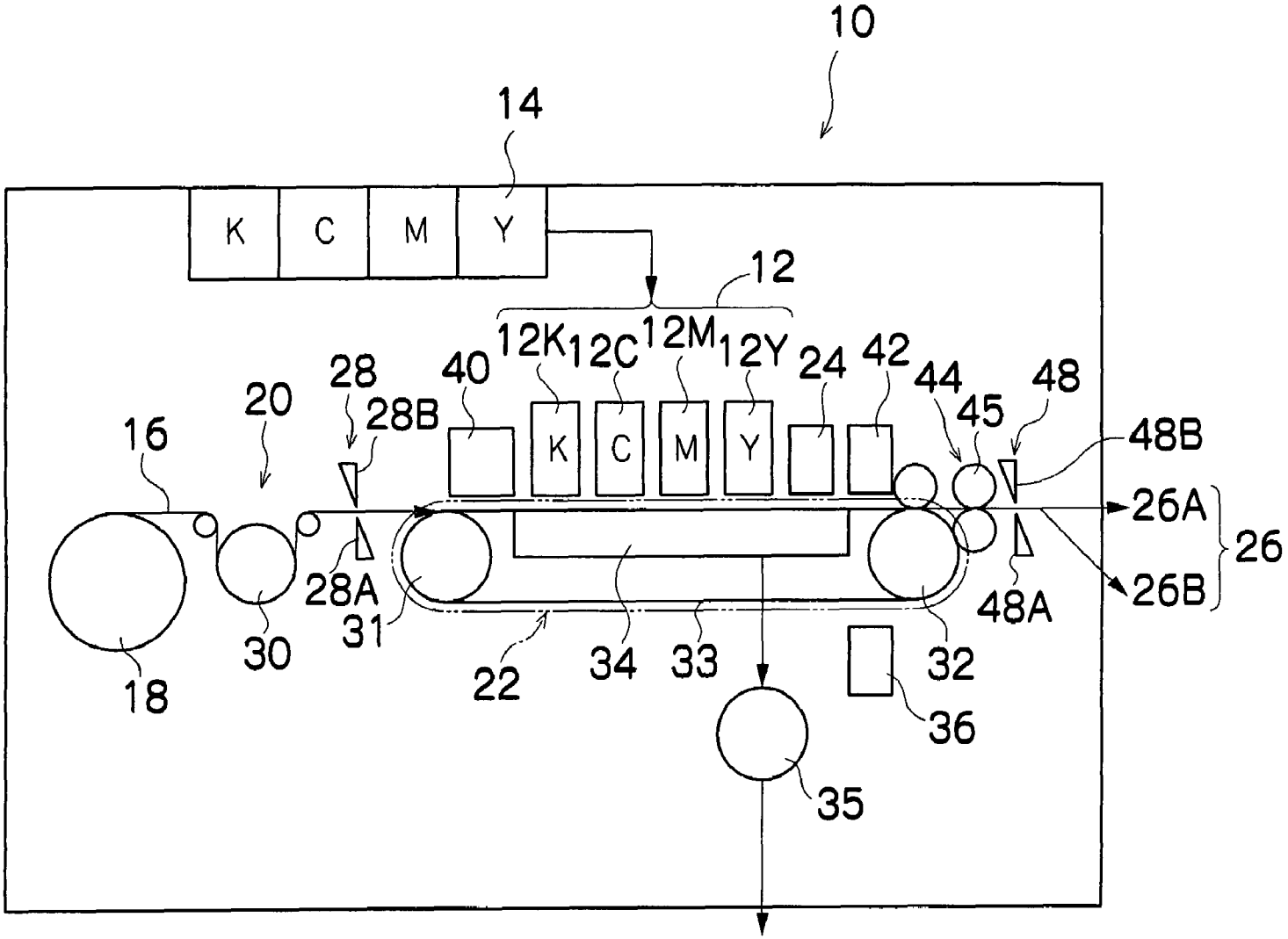
FIG. 1 is general schematic drawing of an inkjet recording apparatus including a print head according to an embodiment of the present invention.

FIG. 1 is general schematic drawing of an inkjet recording apparatus including a print head according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting printed recording paper 16 (printed matter) to the exterior.

In FIG. 1, a magazine for rolled paper (continuous paper) is shown as an example of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink droplet ejection is controlled so that the ink droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. In this, the heating temperature is preferably controlled in such a manner that the recording paper 20 has a curl in which the surface on which the print is to be made is slightly rounded in the outward direction.

In the case of the configuration in which roll paper is used, a cutter (a first cutter) 28 is provided as shown in FIG. 1, and the continuous paper is cut into a desired size by the cutter 28. The cutter 28 has a stationary blade 28A, whose length is no less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the side adjacent to the printed surface across the conveyance path. When cut paper is used, the cutter 28 is not required.

After decurling in the decurling unit 20, the cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction restrictors (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and this suction chamber 34 provides suction with a fan 35 to generate a negative pressure, thereby holding the recording paper 16 onto the belt 33 by suction.

The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different to that of the belt 33, in order to improve the cleaning effect.

Instead of a suction belt conveyance unit 22, it might also be possible to use a roller nip conveyance mechanism, but since the print region passes through the roller nip, the printed surface of the recording paper 16 makes contact with the rollers immediately after printing, and hence smearing of the image is liable to occur. Therefore, a suction belt conveyance mechanism in which nothing comes into contact with the image surface in the printing area is preferable.

A heating fan 40 is provided on the upstream side of the printing unit 12 in the recording paper conveyance path formed by the suction belt conveyance unit 22. This heating fan 40 blows heated air onto the recording paper 16 before printing, and thereby heats up the recording paper 16. Heating the recording paper 16 before printing means that the ink will dry more readily after landing on the paper.

Figure 2:
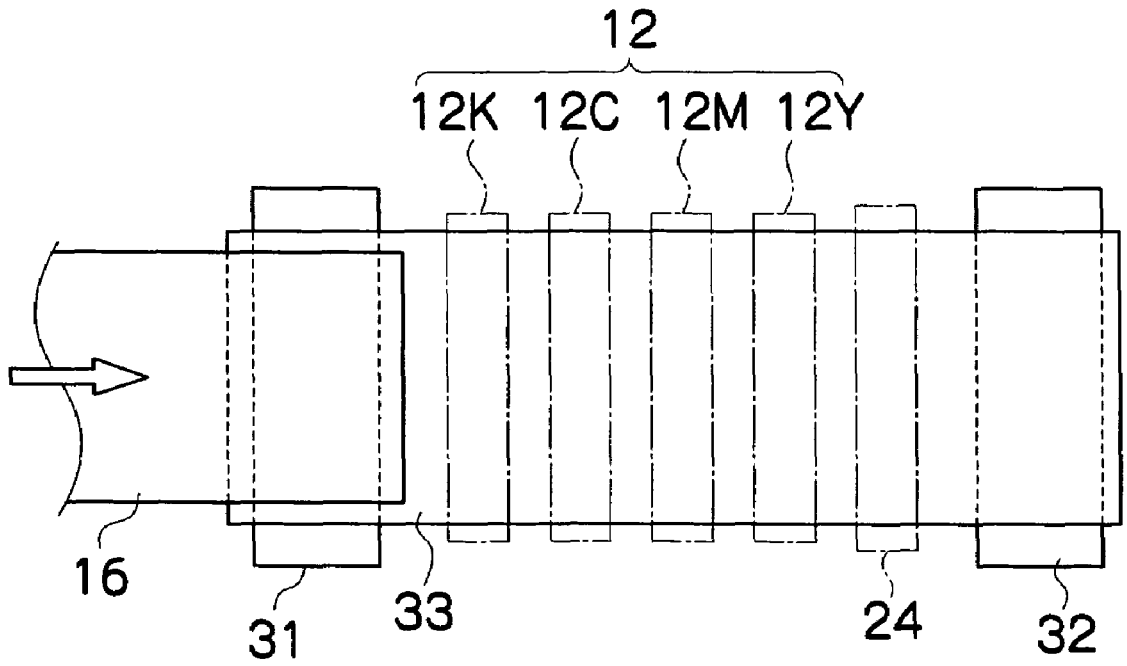
FIG. 2 is a plan view of principal components around a printing unit of the inkjet recording apparatus shown in FIG. 1.

The printing unit 12 is a so-called "full line head" in which a line head having a length corresponding to the maximum paper width is arranged in a direction (main scanning direction) that is perpendicular to the conveyance direction of the recording paper (see FIG. 2). An example of the detailed structure is described below (in FIGS. 3A to 3C and FIG. 5), but each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in the order of black (K), cyan (C), magenta (M), and yellow (Y) from the upstream side, following the feed direction of the recording paper 16 (hereinafter, referred to as the paper conveyance direction). A color print can be formed on the recording paper 16 by ejecting the inks from the print heads 12K, 12C, 12M, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the sub-scanning direction just once (in other words, by means of a single sub-scan). Higher-speed printing is thereby made possible and productivity can be improved in comparison with a shuttle type head configuration in which a print head moves reciprocally in the main scanning direction.

Although a configuration with four standard colors K, C, M, and Y is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has tanks for storing the inks of K, C, M and Y to be supplied to the print heads 12K, 12C, 12M, and 12Y, and the tanks are connected to the print heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric conversion elements with a width that is greater than the ink-droplet ejection width (image recording width) of the print heads 12K, 12C, 12M, and 12Y. This line sensor has a color separation line CCD sensor including a red (R) sensor row composed of photoelectric conversion elements (pixels) arranged in a line provided with an R filter, a green (G) sensor row with a G filter, and a blue (B) sensor row with a B filter.

Instead of a line sensor, it is possible to use an area sensor composed of photoelectric conversion elements which are arranged two-dimensionally.

The print determination unit 24 reads a test pattern image printed by the print heads 12K, 12C, 12M, and 12Y for the respective colors, and the ejection of each print head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Print Head

Next, the structure of a print head will be described. The print heads 12K, 12C, 12M and 12Y of the respective ink colors have the same structure, and a reference numeral 50 is hereinafter designated to any of the print heads.

Figure 3A:
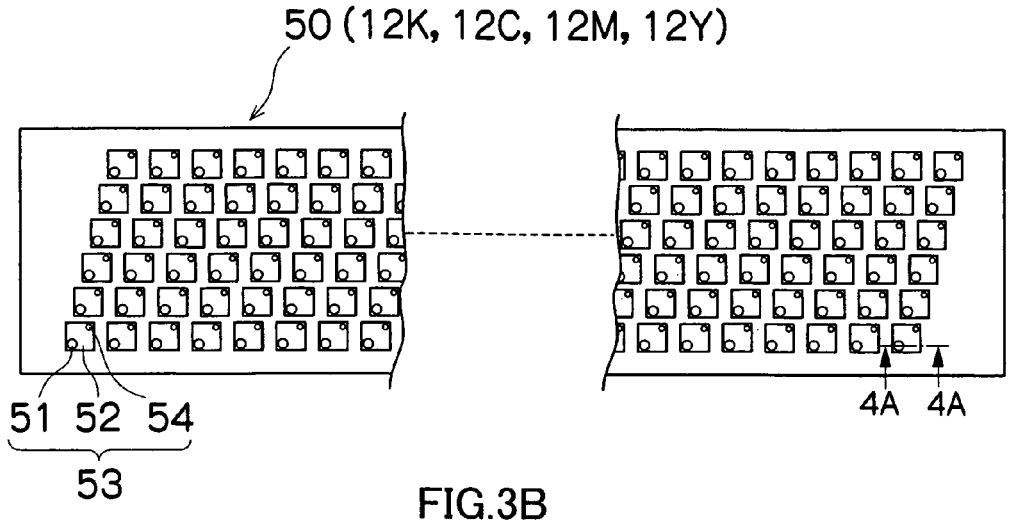
FIGS. 3A to 3C are plan perspective views showing the print head of the inkjet recording apparatus shown in FIG. 1.
Figure 3B:
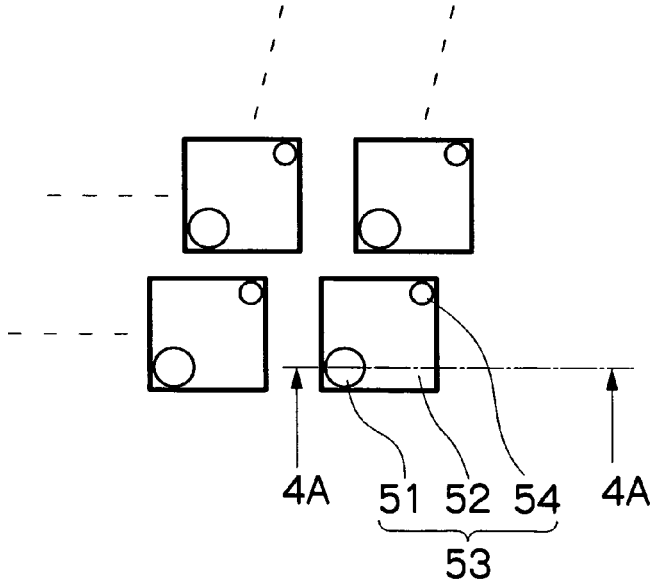
Figure 3C:
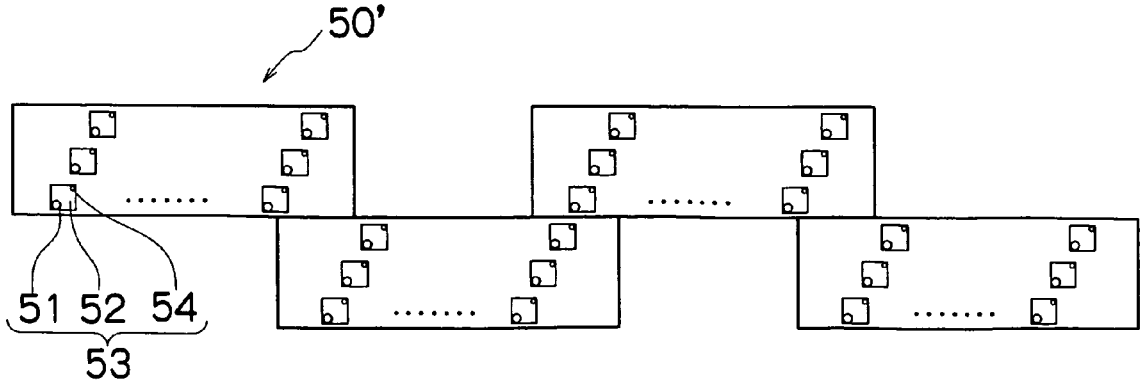
Figure 4A:
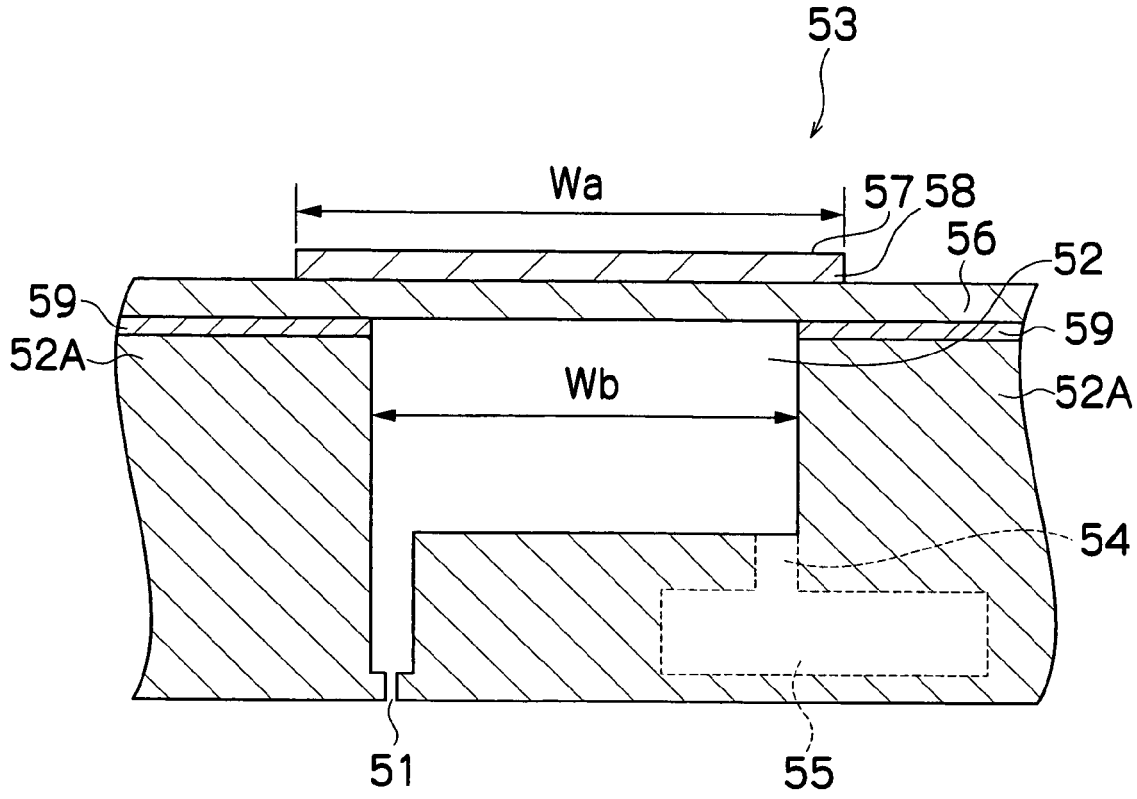
FIGS. 4A and 4B are diagrams showing the detailed structure of an ink chamber unit of the print head.
Figure 4B:
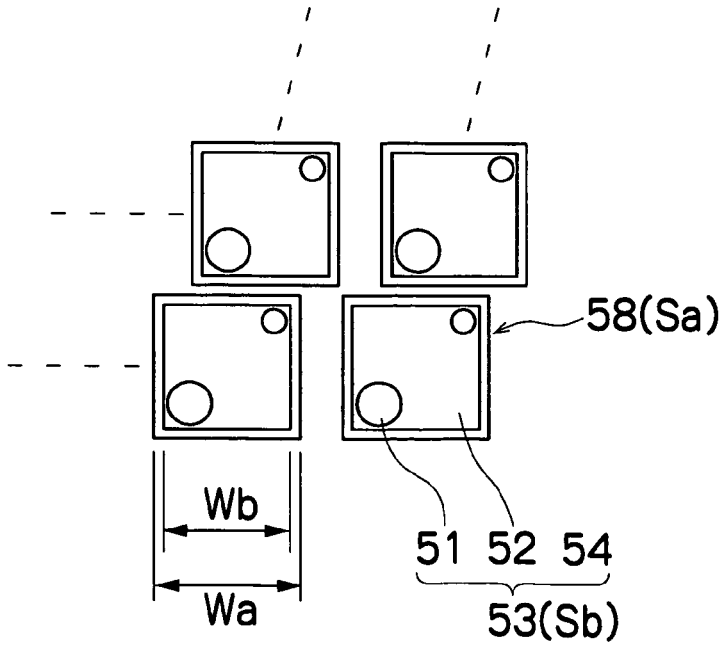

FIG. 3A is a plan view perspective diagram showing an example of the composition of a print head 50, and FIG. 3B is an enlarged diagram of a portion of same. Furthermore, FIG. 3C is a plan view perspective diagram showing a further example of the composition of a print head 50; FIG. 4A is a cross-sectional view showing a three-dimensional composition of an ink chamber unit (being a cross-sectional view along line 4A-4A in FIGS. 3A and 3B); and FIG. 4B is a plan view perspective diagram of same.

In order to achieve a high density of the dot pitch printed onto the surface of the recording medium, it is necessary to achieve a high density of the nozzle pitch in the print head 50. As shown in FIGS. 3A to 3C, and FIGS. 4A and 4B, the print head 50 in the present embodiment has a structure in which a plurality of ink chamber units 53 including nozzles 51 for ejecting ink droplets and pressure chambers 52 corresponding to the nozzles 51 are disposed in the form of a staggered matrix, and the effective nozzle pitch is thereby made small.

More specifically, as shown in FIGS. 3A and 3B, the print head 50 according to the present embodiment is a full-line head having one or more nozzle rows in which a plurality of nozzles 51 for ejecting ink are arranged along a length corresponding to the entire width of the recording medium in a direction substantially perpendicular to the conveyance direction of the print medium (recording paper 16).

Furthermore, as shown in FIG. 3C, it is also possible to use respective print heads 50' of nozzles arranged to a short length in a two-dimensional fashion, and to combine same in a zigzag arrangement, whereby a length corresponding to the full width of the print medium is achieved.

As shown in FIG. 4A, the pressure chamber 52 provided corresponding to each of the nozzles 51 is approximately square-shaped in plan view, and a nozzle 51 and a supply port 54 are provided respectively at either corner of a diagonal of the pressure chamber 52. Each pressure chamber 52 is connected via a supply port 54 to a common channel 55.

A piezoelectric element 58 having an individual electrode 57 is bonded to a diaphragm 56 which forms the ceiling of the pressure chamber 52 (being positioned over the opening section that forms the pressure chamber 52), and the piezoelectric element 58 is caused to deform by applying a drive voltage to the individual electrode 57, thereby generating corresponding distortion (bending deformation) in the diaphragm 56. The pressure chamber 52 deforms in response to this distortion of the diaphragm 56, thus generating a change in the volume of the pressure chamber 52, and a volume of ink corresponding to this volume change is ejected from the nozzle 51. When ink is ejected, new ink is supplied to the pressure chamber 52 from the common channel 55, via the supply port 54.

In other words, the pressure chamber 52 shown in the present embodiment is a bending type chamber which ejects ink due to the compression of the pressure chamber 52 when the diaphragm 56 forming the ceiling of the pressure chamber 52 distorts due to distortion of the piezoelectric element 58. The piezoelectric element 58 is composed so as to principally use displacement in the $d_{31}$ direction (in other words, a $d_{31}$ mode piezoelectric element is used).

Moreover, as shown in FIG. 4B, the pressure chamber 52 and the piezoelectric element 58 according to the present embodiment have a similar planar shape. The planar face area Sa of the piezoelectric element 58 is greater than the ceiling face area Sb of the pressure chamber 52 (the face on which the diaphragm 56 is formed), (in other words, the planar face area Sa of the piezoelectric element 58 and the ceiling face area Sb of the pressure chamber 52 satisfy the relationship Sa>Sb), and the piezoelectric element 58 is disposed in a position overlapping with the pressure chamber 52.

More specifically, in the piezoelectric element 58 and the pressure chamber 52 described above, the length (width) Wa of one edge of the piezoelectric element 58 and the length Wb of the edge of the pressure chamber 52 corresponding to this edge satisfy the relationship Wa>Wb, in such a manner that the piezoelectric element 58 is disposed in a position overlapping with the ceiling of the pressure chamber 52.

Incidentally, the piezoelectric element 58 may be positioned so as to overlap partially with the pressure chamber 52, or it may be positioned so as to overlap completely with same.

In the present embodiment, pressure chambers and piezoelectric elements having an approximately square planar shape are described, but the planar shape of the pressure chambers and piezoelectric elements may be a quadrilateral shape other than an approximately square shape. Also, the planar shape may be a polygonal shape other than a quadrilateral shape, or a circular shape, or an irregular shape other than those.

If the pressure chambers 52 and piezoelectric elements 58 have a circular shape, then the diameters thereof should be used instead of the respective widths. Furthermore, if the pressure chambers 52 and piezoelectric elements 58 have a polygonal shape other than a quadrilateral shape, or an irregular shape, then a quantity corresponding to the width of a square shape (for instance, the length of the diagonal thereof) should be used as appropriate.

Though FIG. 4B shows a mode where the planar shape of the pressure chamber 52 and the planar shape of the piezoelectric element 58 are similar, the planar shape of the pressure chamber 52 and the planar shape of the piezoelectric element 58 do not need to be the same, for instance, one of the planar shapes may be square and the other planar shape may be rectangular.

However, in consideration of increasing the density of the print head 50, it is preferable that the planar shape of the pressure chamber 52 and the planar shape of the piezoelectric element 58 are the same.

Furthermore, as shown in FIG. 4A, an adhesive having a lower rigidity than a generally used adhesive is employed in the bonding member 59 which bonds the diaphragm 56 to the pressure chamber wall 52A forming the side faces of the pressure chamber 52.

On the other hand, the pressure chamber wall 52A are made of a different material to the bonding member 59, and the different material is used to a high-rigidity member of metal, ceramic, or the like, which does not deform in such a manner that it affects ejection, even when the piezoelectric element 58 is driven. The Young's modulus of the material forming the pressure chamber wall 52A used in the present embodiment is approximately 200 GPa. The detailed structure of the ink chamber unit 53 is described below.

Figure 5:
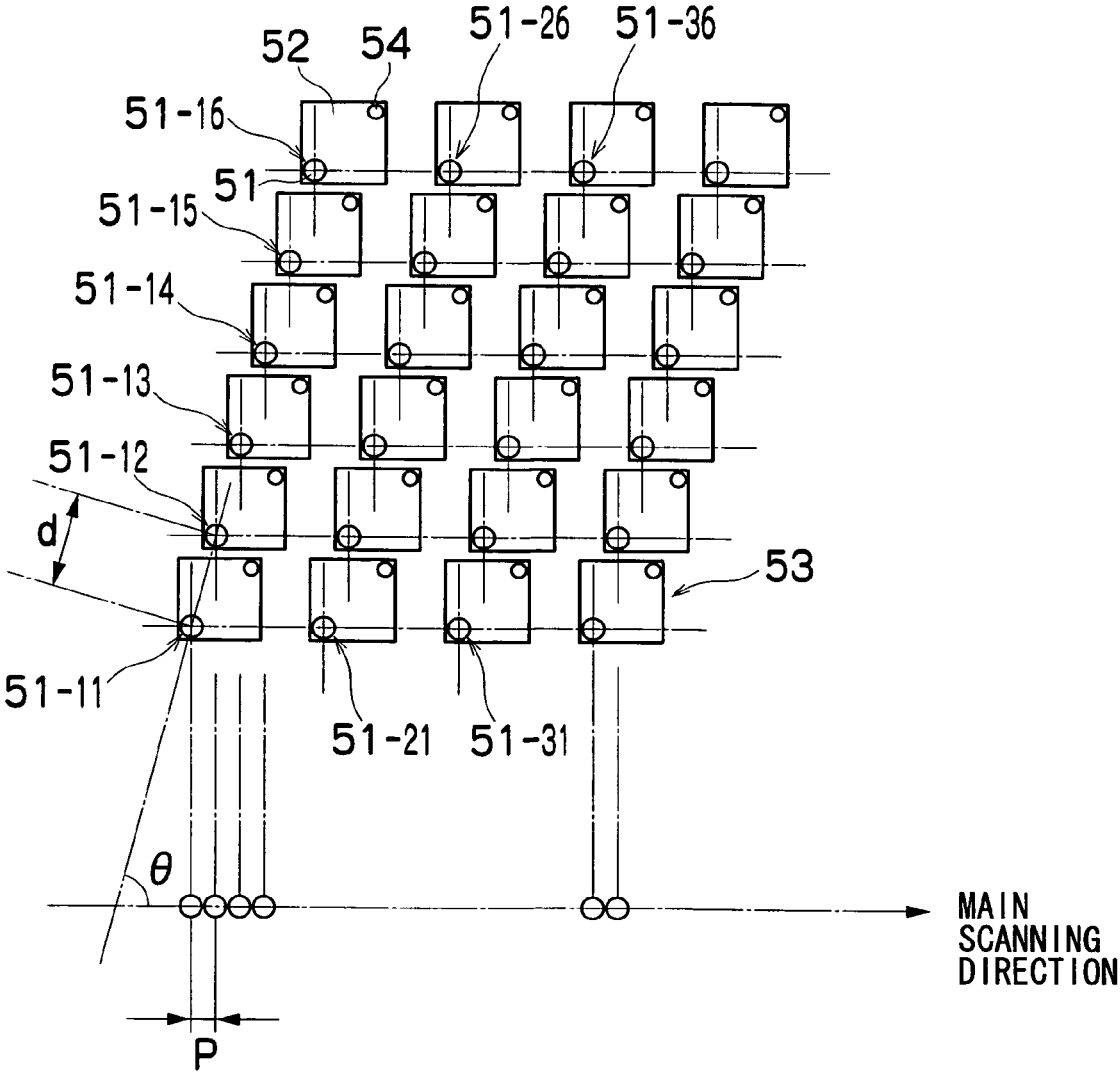
FIG. 5 is an enlarged view showing a nozzle arrangement in the print head shown in FIGS. 3A to 3C.

As shown in FIG. 5, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of θ with respect to the main scanning direction. By adopting a structure wherein a plurality of ink chamber units 53 are arranged at a uniform pitch d in a direction having an angle θ with respect to the main scanning direction, the pitch P of the nozzles when projected to an alignment in the main scanning direction will be d×cosθ.

More specifically, the arrangement can be treated equivalently to one in which the respective nozzles 51 are arranged in a linear fashion at a uniform pitch P, in the main scanning direction. By means of this composition, it is possible to achieve a nozzle composition of high density, in which the nozzle columns projected to an alignment in the main scanning direction reach a total of 2400 per inch (2400 nozzles per inch). Hereinafter, in order to facilitate the description, it is supposed that the nozzles 51 are arranged in a linear fashion at a uniform pitch (P), in the longitudinal direction of the head (main scanning direction).

In a full-line head comprising rows of nozzles corresponding to the entire width of the image recordable width, "main scanning" is defined as printing a line formed of a row of dots, or a line formed of a plurality of rows of dots in the width direction of the recording paper 16 (the direction perpendicular to the conveyance direction of the recording paper) by controlling the driving of the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of a line formed of a row of dots, or a line formed of a plurality of rows of dots, formed by the main scanning, while moving the full-line head and the recording paper relatively to each other.

When implementing the present invention, the arrangement of the nozzles is not limited to that of the example illustrated. For example, one nozzle row may be provided in the main scanning direction, or a plurality of nozzles may be arranged in the sub-scanning direction.

Configuration of Ink Supply System

Figure 6:
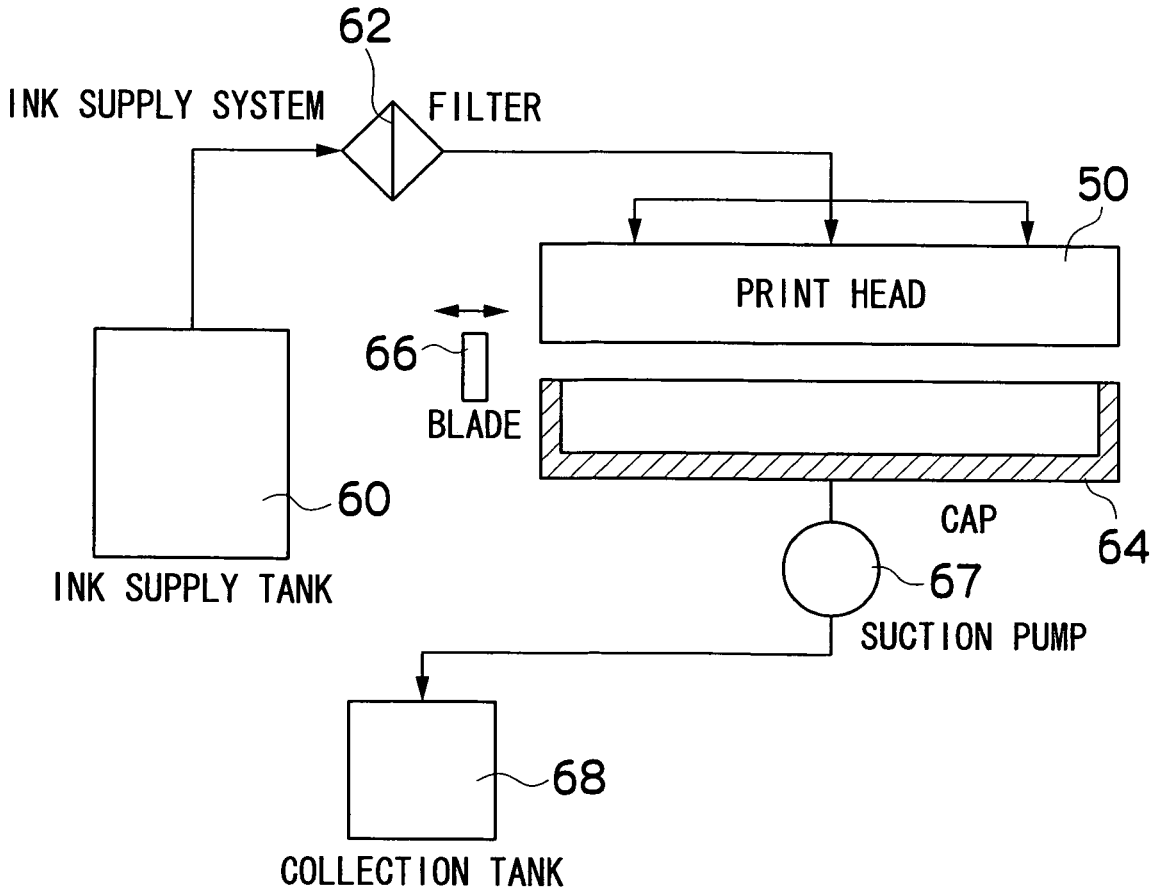
FIG. 6 is a schematic drawing showing a configuration of an ink supply system in the inkjet recording apparatus including the print head according to the embodiment of the present invention.

FIG. 6 is a schematic drawing showing the configuration of the ink supply system in the inkjet recording apparatus 10.

The ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing and loading unit 14 in FIG. 1 described above.

A filter 62 for removing foreign matters and bubbles is disposed between the ink supply tank 60 and the print head 50 as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle face 50A is thereby covered with the cap 64.

During printing or standby, if the use frequency of a particular nozzle 51 is low, and if it continues in a state of not ejecting ink for a prescribed time period or more, then the solvent of the ink in the vicinity of the nozzle evaporates and the viscosity of the ink increases. In a situation of this kind, it becomes impossible to eject ink from the nozzle 51, even if the piezoelectric element 58 is operated.

Therefore, before a situation of this kind develops (namely, while the ink is within a range of viscosity which allows it to be ejected by operation of the piezoelectric element 58), the piezoelectric element 58 is operated, and a preliminary ejection ("purge", "blank ejection", "liquid ejection" or "dummy ejection") is carried out in the direction of the cap 64 (ink receptacle), in order to expel the degraded ink (namely, the ink in the vicinity of the nozzle which has increased viscosity).

Furthermore, if air bubbles enter into the ink inside the print head 50 (inside the pressure chamber 52), then even if the piezoelectric element 58 is operated, it will not be possible to eject ink from the nozzle. In a case of this kind, the cap 64 is placed on the print head 50, the ink (ink containing air bubbles) inside the pressure chamber 52 is removed by suction, by means of a suction pump 67, and the ink removed by suction is then supplied to a collection tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 52, the ink consumption is considerably large. Therefore, preliminary ejection is preferably carried out while the increase in the viscosity of the ink is still minor.

The cleaning blade 66 is composed of rubber or another elastic member, and can slide on the ink ejection surface (surface of the nozzle plate) of the print head 50 by means of a blade movement mechanism (wiper) (not shown). When ink droplets or foreign matter has adhered to the nozzle plate, the surface of the nozzle plate is wiped and cleaned by sliding the cleaning blade 66 on the nozzle plate.

Description of Control System

Figure 7:
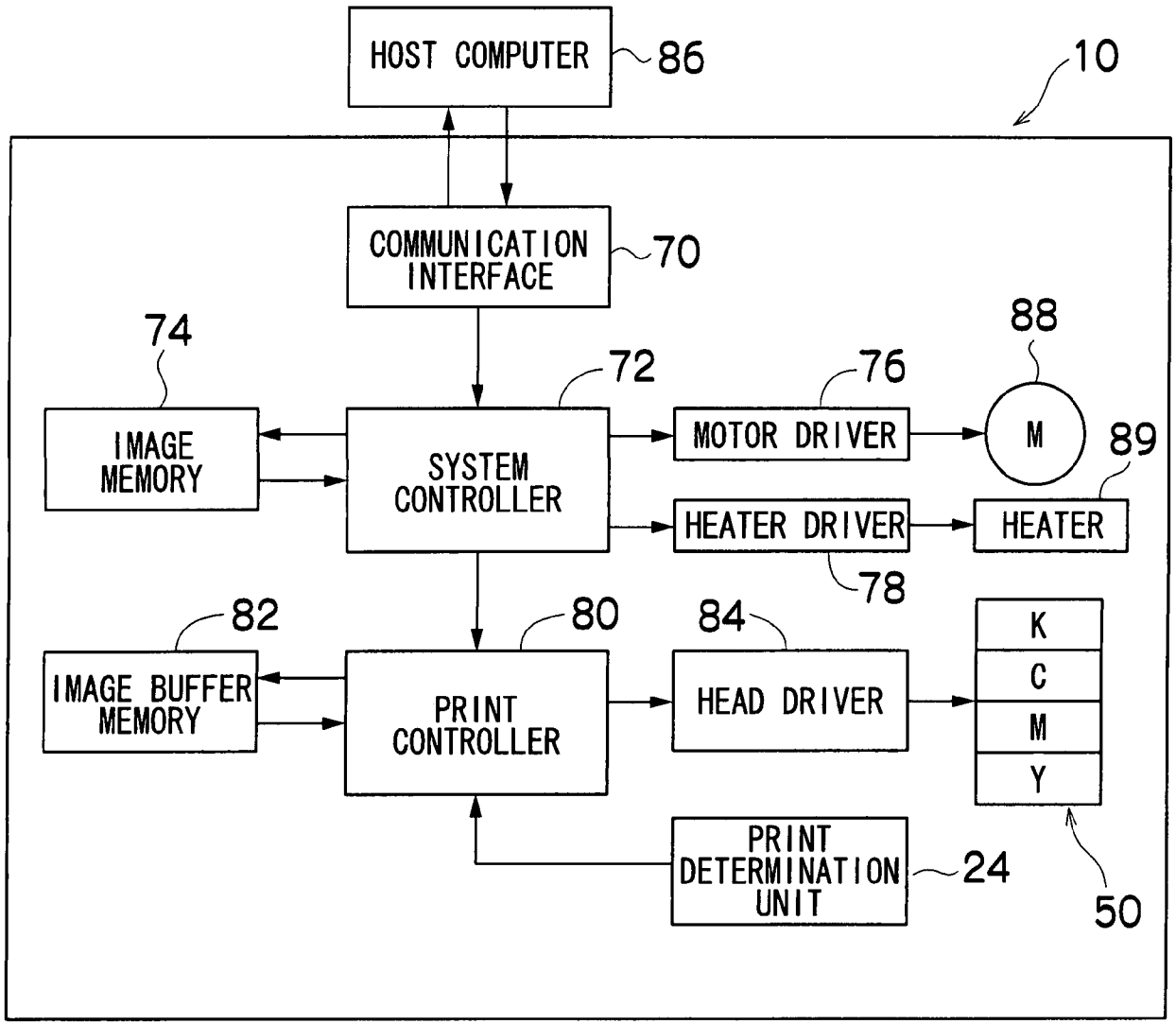
FIG. 7 is a block diagram showing a system configuration of the inkjet recording apparatus including the print head according to the embodiment of the present invention.

FIG. 7 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller (drive controlling device) 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74.

The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the image memory 74. The image memory 74 may be a non-writeable storage device, or it may be a rewriteable storage device, such as an EEPROM. The image memory 74 is used as a temporary storage region for the image data, and it is also used as a program development region and a calculation work region for the CPU.

The motor driver 76 drives the motor 88 in accordance with commands from the system controller 72. The heater driver 78 drives the heater 89 of the post-drying unit 42 or the like in accordance with commands from the system controller 72.

The print controller 80 has a signal processing function for performing various tasks, compensations, and other types of processing for generating print control signals (drive signals) from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric elements of the print heads 12K, 12C, 12M, and 12Y of the respective colors K, C, M, and Y according to the print data supplied by the print controller 80. The head driver 84 can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color in the print controller 80. In other words, the print controller 80 performs processing for converting the inputted RGB image data into dot data for four colors K, C, M, and Y. The dot data generated by the print controller 80 is stored in the image buffer memory 82.

The head driver 84 drives the piezoelectric element 58 of the print heads 12K, 12C, 12M, and 12Y of the respective colors K, C, M, and Y, according to the print data supplied by the print controller 80. A feedback control system for maintaining constant drive conditions for the print heads may be included in the head driver 84.

Various control programs are stored in a program storage section (not illustrated), and a control program is read out and executed in accordance with commands from the system controller 72. The program storage section may use a semiconductor memory, such as a ROM, EEPROM, or a magnetic disk, or the like. An external interface may be provided, and a memory card or PC card may also be used. Naturally, a plurality of storage media out of those may also be provided.

The program storage section may also be combined with a storage device for storing operational parameters, and the like (not illustrated).

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

As required, the print controller 80 makes various corrections with respect to the print head 50 according to information obtained from the print determination unit 24.

In the example shown in FIG. 1, the print determination unit 24 is provided on the print surface side, the print surface is irradiated with a light source (not illustrated), such as a cold cathode fluorescent tube disposed in the vicinity of the line sensor, and the reflected light is read in by the line sensor. However, in implementing the present invention, another composition may be adopted.

In the present embodiment, full line type of print head is described as an example of a print head, but the present invention may also be applied to a shuttle type head.

Detailed Structure of Ink Chamber Unit

Next, the structure of the ink chamber unit 53 shown in FIGS. 4A and 4B will be described in detail.

Figure 8:
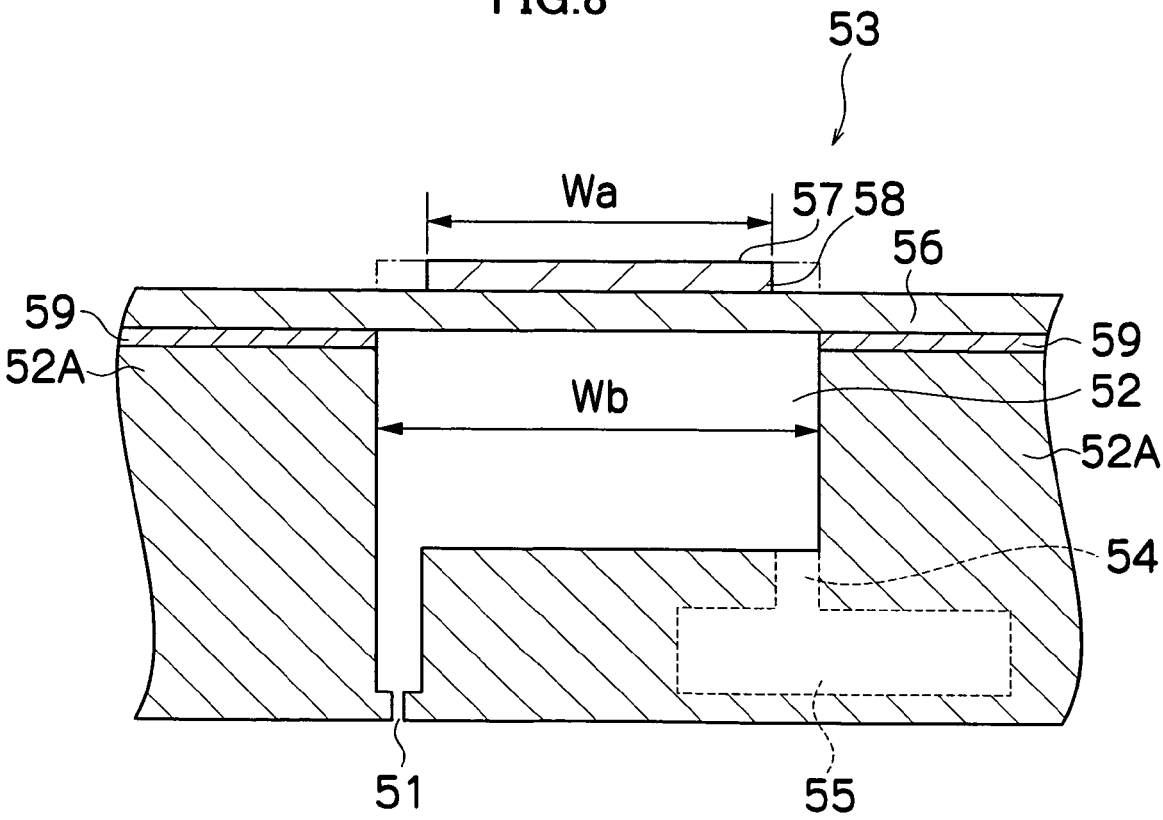
FIG. 8 is a cross-sectional view showing a structure of an ink chamber unit relating to the prior art.

FIG. 8 is a cross-sectional view showing a three-dimensional composition of an ink chamber unit 53 relating to the prior art. In FIG. 8, identical reference numerals denote parts that are common to FIG. 4A, and description thereof is omitted here.

As shown in FIG. 8, in the ink chamber unit 53 relating to the prior art, the width Wa of the piezoelectric element 58 is smaller than the width Wb of the pressure chamber 52, and the piezoelectric element 58 is disposed in a position where it does not overlap with the ceiling face of the pressure chamber 52.

However, the width Wa of the piezoelectric element 58 and the width Wb of the pressure chamber may be substantially equal (indicated by the dotted lines in FIG. 8), and the planar face area Sa of the piezoelectric element 58 and the ceiling face area Sb of the pressure chamber 52 may be substantially equal.

In other words, the relationship between the width Wa of the piezoelectric element 58 and the width Wb of the pressure chamber 52 is such that $Wa \leqq Wb$, and the relationship between the planar face area Sa of the piezoelectric element 58 and the ceiling face area Sb of the pressure chamber 52 is such that $Sa \leqq Sb$.

Furthermore, a general epoxy type adhesive is used for the bonding member 59 which bonds the pressure chamber wall 52A and the diaphragm 56, and the Young's modulus of this adhesive is between approximately several GPa and several ten GPa.

In an ink chamber unit 53 having this composition, if the nozzle pitch is taken to be 2400 npi, then either the planar size of the piezoelectric element 58 (the face area Sa) and the size of the ceiling face of the pressure chamber 52 (face area Sb) is a square measuring approximately 300 μm per side. Furthermore, the piezoelectric element 58 relating to the prior art has a thickness of approximately 30 μm, and in a piezoelectric element 58 having a size of this order, it is difficult to ensure a satisfactory amount of displacement of the diaphragm 56 (piezoelectric element 58) in order to eject high-viscosity ink having a higher viscosity than normally used ink (for example, an ink having a viscosity of 10 cP to 50 cP, where 1 P is 0.1 Pa·s).

It is considered to reduce the thickness of the piezoelectric element 58 for ensuring sufficient displacement of the diaphragm 56, but it is extremely difficult to process the piezoelectric element to a thickness of 30 μm or less by means of a grinding process, or the like.

Furthermore, generally, when a piezoelectric element 58 is formed as a thin film by means of a thin film method, such as sputtering or gel sol, it is not possible to obtain a piezoelectric d constant on a par with a bulk member, but rather the piezoelectric d constant tends to be lower, and therefore the pressure generated at the same applied voltage is also lower.

In the ink chamber units 53 of the print head 50 according to the present invention, as shown in FIGS. 4A and 4B, a low-rigidity adhesive is used in the bonding member 59 between the pressure chamber wall 52A and the diaphragm 56 so as to contribute to increasing the displacement of the diaphragm 56. By reducing the rigidity of the bonding member 59, it is possible to increase the amount of displacement of the diaphragm 56 (in other words, the amount of displacement of the pressure chamber 52), when the same pressure is applied to the diaphragm 56 by the piezoelectric element 58.

An epoxy type adhesive is used as the low-rigidity adhesive. The bonding member 59 (adhesive) is made sufficiently thinner than the diaphragm 56 and the pressure chamber wall 52A. Furthermore, it is preferable that the thickness of the bonding member 59 is varied according to its rigidity, in such a manner that its thickness is increased when it has high relative rigidity (if it is hard), and its thickness is reduced when it has low relative rigidity (if it is soft).

However, if the rigidity of the bonding member 59 (and particularly, the rigidity in the vertical direction in FIG. 4A) is low, then pressure loss will occur in the bonding member 59, so that the pressure applied to the diaphragm 56 from the piezoelectric element 58 is decline.

In order to prevent this pressure loss (pressure reduction), the width Wa of the piezoelectric element 58 is made sufficiently larger than the width Wb of the pressure chamber 52, and the piezoelectric element 58 overlaps with the ceiling face of the pressure chamber 52. Furthermore, by adopting a composition of this kind, it is possible to reduce variations in the amount of displacement of the diaphragm 56 caused by variations in the bonding position of the piezoelectric element 58.

Relationship Between Shape and Position of Piezoelectric Element and Pressure Chamber Next, the relationship between the width Wa of the piezoelectric element 58 and the width Wb of the pressure chamber 52 will be described with reference to FIG. 9 and FIG. 10.

Figure 9:
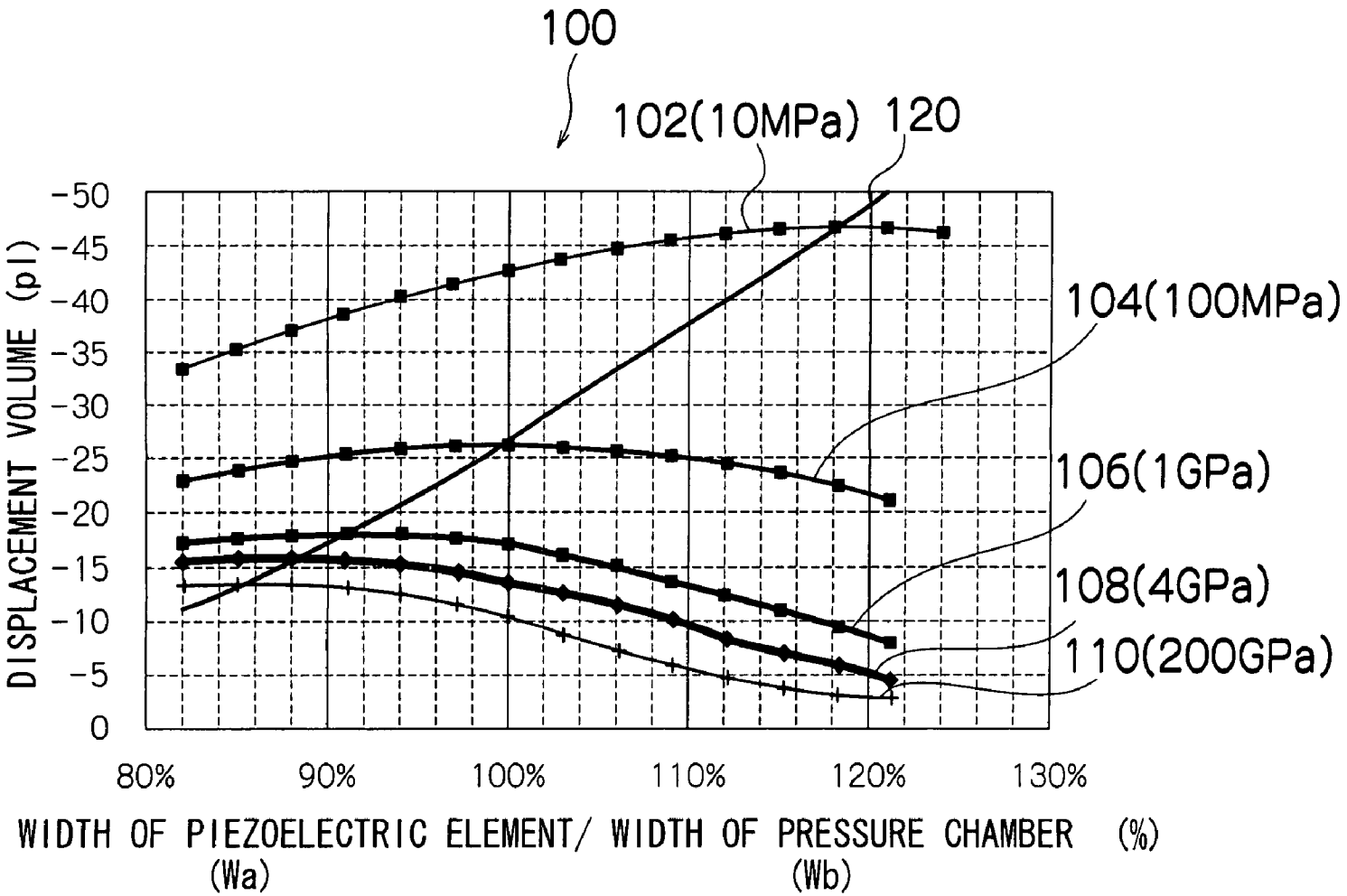
FIG. 9 is a graph showing the relationship between the width of the piezoelectric element/width of the pressure chamber and the displacement volume of the pressure chamber.

FIG. 9 shows a graph 100 showing the relationship between the ratio Wa/Wb (%) of the width Wa of the piezoelectric element 58 with respect to the width Wb of the pressure chamber 52, and the displacement volume (pl) of the pressure chamber 52. In FIG. 9, the curves 102 to 110 indicate the aforementioned relationship in cases in which the rigidity of the bonding member 59 is 10 MPa, 100 MPa, 1 GPa, 4 GPa, and 200 GPa, respectively. In addition, the curve 120 indicates the maximum value of the displacement volume for respective ratios of the width Wa of the piezoelectric element 58 with respect to the width Wb of the pressure chamber 52. Furthermore, the positive direction of the displacement volume of the pressure chamber 52 shown in FIG. 9 indicates a direction in which the volume of the pressure chamber increases, and the negative direction indicates a direction in which the volume of the pressure chamber 52 decreases.

As shown in FIG. 9, it can be realized that the displacement volume of the pressure chamber 52 increases when the rigidity of the bonding member 59 decreases (when the Young's modulus decreases), regardless of the ratio between the width Wa of the piezoelectric element 58 and the width Wb of the pressure chamber 52.

In addition, according to the curve 120 in the graph 100, at a Young's modulus of 10 MPa, a maximum displacement volume of the pressure chamber 52 can be achieved when the ratio of the width Wa of the piezoelectric element 58 with respect to the width Wb of the pressure chamber 52 is 120%. At a Young's modulus of 100 MPa, a maximum displacement volume of the pressure chamber 52 can be achieved when the ratio of the width Wa of the piezoelectric element 58 with respect to the width Wb of the pressure chamber 52 is 95%.

At a Young's modulus of 1 GPa to 200 GPa that the bonding member 59 has relatively high rigidity, the displacement volume of the pressure chamber 52 tends to decrease when the ratio of the width Wa of the piezoelectric element 58 with respect to the width Wb of the pressure chamber 52 increases.

On the other hand, at a Young's modulus of 100 MPa (on the curve 104) that the bonding member 59 has low rigidity, when the ratio of the width Wa of the piezoelectric element 58 with respect to the width Wb of the pressure chamber 52 is in a range of greater than 100% and no more than 105%, the displacement volume of the pressure chamber 52 remains virtually uniform even if the ratio of the width Wa of the piezoelectric element 58 with respect to the width Wb of the pressure chamber 52 increases.

Furthermore, in the case in which the ratio of the width Wa of the piezoelectric element 58 with respect to the width Wb of the pressure chamber 52 is in a range of greater than 105% and no more than 110%, the displacement volume of the pressure chamber 52 tends to decrease gradually when the ratio of the width Wa of the piezoelectric element 58 with respect to the width Wb of the pressure chamber 52 increases. When the ratio of the width Wa of the piezoelectric element 58 with respect to the width Wb of the pressure chamber 52 exceeds 110%, the ratio of decrease in the displacement volume of the pressure chamber 52 becomes greater.

Moreover, at a Young's modulus of 10 MPa (on the curve 102) that the bonding member 59 has low rigidity, if the ratio of the width Wa of the piezoelectric element 58 with respect to the width Wb of the pressure chamber 52 is no more than 120%, then the displacement volume of the pressure chamber 52 tends to increase when the ratio of the width Wa of the piezoelectric element 58 with respect to the width Wb of the pressure chamber 52 of the pressure chamber 52 is increased.

In other words, when the ratio Wa/Wb of the width Wa of the piezoelectric element 58 with respect to the width Wb of the pressure chamber 52 is in a range of greater than 100% and no more than 110%, the displacement volume of the pressure chamber 52 can be increased by setting the Young's modulus of the bonding member 59 to 100 MPa or less. More desirably, the Young's modulus of the bonding member 59 is set to 10 MPa or less.

Next, the relationship shown in FIG. 10 between the ratio (%) of the width Wa of the piezoelectric element 58 with respect to the width Wb of the pressure chamber 52, and the pressure (MPa) applied to the pressure chamber 52, will be described.

Figure 10:
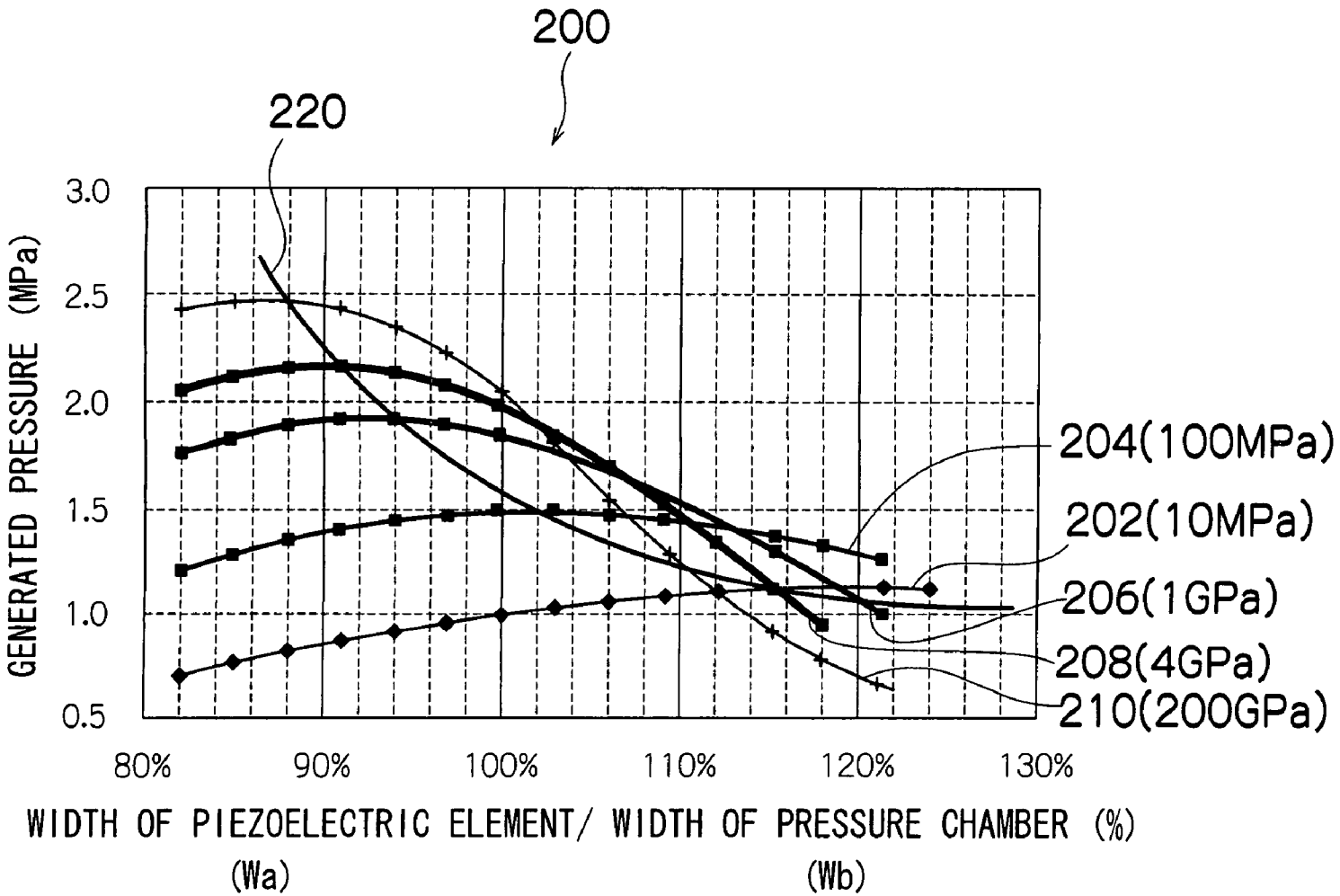
FIG. 10 is a graph showing the relationship between the width of the piezoelectric element/width of the pressure chamber and the pressure generated by the piezoelectric element.

FIG. 10 is a graph 200 showing the relationship between the ratio of the width of the piezoelectric element 58 with respect to the width Wb of the pressure chamber 52, and the pressure generated by the piezoelectric element 58 (namely, the pressure applied to the pressure chamber 52). In FIG. 10, the curves 202 to 210 indicate the aforementioned relationship in cases in which the rigidity of the bonding member 59 is 10 MPa, 100 MPa, 1 GPa, 4 GPa, and 200 GPa, respectively. In addition, the curve 220 indicates the maximum force generated for respective ratios of the width Wa of the piezoelectric element 58 with respect to the width Wb of the pressure chamber 52.

As shown in FIG. 10, in the case in which the ratio of the width Wa of the piezoelectric element 58 with respect to the width Wb of the pressure chamber 52 is 100% or less (in other words, in an ink chamber unit 53 relating to the prior art), the pressure generated by the piezoelectric element 58 declines when the rigidity of the bonding member 59 is lowered (when the Young's modulus is reduced).

On the other hand, in the case in which the ratio of the width Wa of the piezoelectric element 58 with respect to the width Wb of the pressure chamber 52 exceeds 100% (in other words, in an ink chamber unit 53 according to the present invention), the pressure generated by the piezoelectric element 58 behaves as described below.

At a Young's modulus of 1 GPa to 200 GPa that the bonding member 59 has relatively high rigidity, when the ratio of the width Wa of the piezoelectric element 58 with respect to the width Wb of the pressure chamber 52 increases, the pressure generated by the piezoelectric element 58 tends to decrease. In particular, at the Young's modulus of 200 GPa (on the curve 210), the pressure generated by the piezoelectric element 58 tends to decrease to a minimum.

In addition, in the case in which the bonding member 59 has a Young's modulus of 100 MPa (on the curve 204), when the ratio of the width Wa of the piezoelectric element 58 with respect to the width Wb of the pressure chamber 52 is in a range of greater than 100% and no more than 110%, the pressure generated by the piezoelectric element 58 remains virtually uniform, even if the ratio of the width Wa of the piezoelectric element 58 with respect to the width Wb of the pressure chamber 52 is increased.

In the case in which the bonding member 59 has a Young's modulus of 10 MPa (on the curve 202), the pressure generated by the piezoelectric element 58 tends to increase when the ratio of the width Wa of the piezoelectric element 58 with respect to the width Wb of the pressure chamber 52 increases.

Furthermore, according to the curve 220 in the graph 200, in the case in which the Young's modulus of the bonding member 59 is 100 MPa, the pressure generated by the piezoelectric element 58 is a maximum when the ratio of the width Wa of the piezoelectric element 58 with respect to the width Wb of the pressure chamber 52 is approximately 100%. In the case in which the Young's modulus of the bonding member 59 is 10 MPa, the pressure generated by the piezoelectric element 58 is a maximum when the ratio of the width Wa of the piezoelectric element 58 with respect to the width Wb of the pressure chamber 52 is approximately 115%.

In other words, in order for increasing the displacement volume of the pressure chamber 52 while suppressing reduction in the pressure generated by the piezoelectric element 58, the pressure chamber 52 and piezoelectric element 58 are composed in such a manner that the ratio of the width Wa of the piezoelectric element 58 with respect to the width W)b of the pressure chamber 52 is greater than 100% and no more than 110%, and the bonding member 59 is composed so as to have a Young's modulus of 100 MPa or less.

Figure 11:
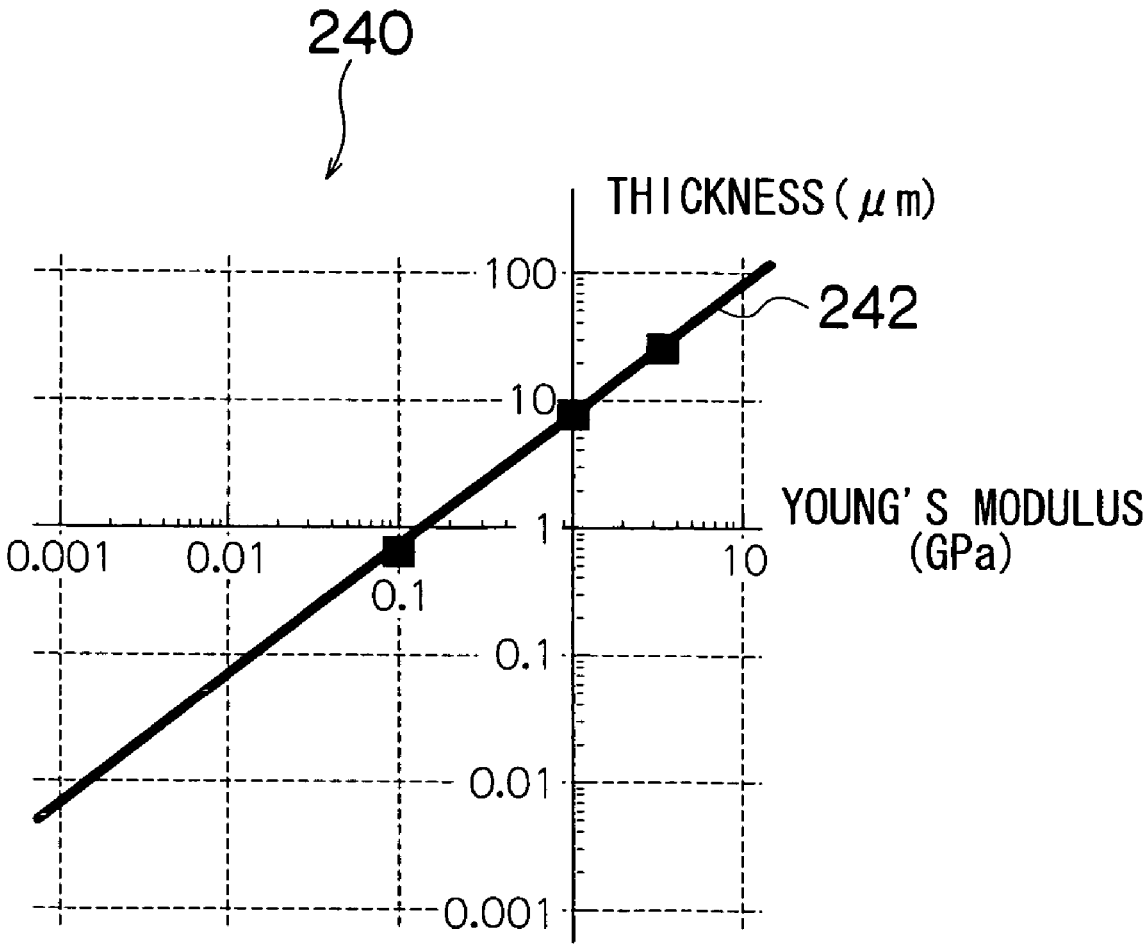
FIG. 11 is a graph showing the relationship between a Young's modulus and a thickness of a bonding member.

Here, the relationship between the thickness and the Young's modulus of the bonding member 59 is shown in FIG. 11. The graph 240 in FIG. 11 shows the Young's modulus of the bonding member 59 on the horizontal axis and the thickness of the bonding member 59 on the vertical axis. The curve 242 indicates the Young's modulus (on the horizontal axis) and the thickness (on the vertical axis) of the bonding member 59 which can obtain displacement volume of 10 pl in the pressure chamber 52 when the piezoelectric element 58 is driven by applying a drive voltage of 60V.

As shown in FIG. 11, when the Young's modulus of the bonding member 59 is 1 GPa, the thickness is approximately 10 μm; when the Young's modulus is 0.1 GPa (100 MPa), the thickness is approximately 1 μm; and when the Young's modulus is 0.01 GPa (10 MPa), the thickness is approximately 0.1 μm.

In consideration of the bonding strength and the accuracy relating to the thickness of the bonding member, it is preferable that the actual bonding thickness be several μm or greater. Thus, according to those thickness conditions, it is desirable that the Young's modulus of the bonding member 59 be approximately 1 GPa.

More specifically, if the Young's modulus of the bonding member 59 is 1 GPa or lower, and the ratio of the width Wa of the piezoelectric element 58 with respect to the width Wb of the pressure chamber 52 is in a range of greater than 100% and no more than 110%, then it is possible to increase the displacement volume of the pressure chamber 52, while also restricting reduction in the pressure applied to the pressure chamber 52, thereby obtaining the beneficial effects of the present invention.

Furthermore, the lower limit of the rigidity of the bonding member 59 is determined by the adhesive material used, and the rigidity of the adhesive used in the present embodiment is 1 MPa or above.

Relationship Between Manufacturing Variations and Variations in Displacement Volume of Pressure Chamber Next, the relationship between variation in the bonding position of the piezoelectric element 58 and variation in the displacement volume of the pressure chamber 52 will be described.

FIG. 12 shows the relationship between the bonding position of the piezoelectric element 58 and the displacement volume of the pressure chamber 52, and the relationship between the bonding position of the piezoelectric element 58 and the pressure generated by the piezoelectric element 58. In FIG. 12, the unit of the displacement volume is pl, and the unit of the generated pressure is MPa.

As shown in FIG. 12, in the case in which the Young's modulus of the bonding member 59 is 0.01 GPa (10 MPa), even if the bonding position of the piezoelectric element 58 is shifted by 10 μm from the original bonding position, the pressure generated by the piezoelectric element 58 increases by 0.47%. Therefore, even if the piezoelectric element 58 is shifted in position, the pressure generated by the piezoelectric element 58 does not decline.

On the other hand, in the case in which the Young's modulus of the bonding member 59 is 1 GPa, when the piezoelectric element 58 is shifted out of position, the pressure generated by the piezoelectric element 58 decreases by 1.37%. In the case in which the Young's modulus of the bonding member 59 is 200 GPa, since the piezoelectric element 58 is shifted out of position, the pressure generated by the piezoelectric element 58 decreases by 1.6%.

In other words, in the case in which the Young's modulus of the bonding member 59 is no more than 1 GPa, even if manufacturing variations arise, such as variation in the bonding position of the piezoelectric element 58, it is possible to reduce variation in the pressure generated by the piezoelectric element 58.

Since the amount of displacement of the diaphragm 56 generally varies with the thickness of the bonding member 59, it is desirable that the thickness of the bonding member 59 is increased when the bonding member 59 has a high Young's modulus, and that the thickness of the bonding member 59 is decreased when it has a low Young's modulus.

In a print head 50 having the composition described above, the bonding member 59 between the pressure chamber wall 52A and the diaphragm 56 is a low-rigidity member having a Young's modulus in the range of 1 MPa to 1 GPa, and furthermore, the width of the piezoelectric element 58 is greater than the width of the pressure chamber 52 of the ink chamber unit 53, and the piezoelectric element 58 overlaps with the ceiling face of the pressure chamber 52. Consequently, it is possible to increase the displacement volume of the pressure chamber 52 by increasing the displacement of the diaphragm 56 while also suppressing any reduction in the pressure generated by the piezoelectric element 58. In addition, it is also possible to suppress any reduction in the pressure generated by the piezoelectric element 58 due to manufacturing variations, and satisfactory ejection can be achieved even when using a high-viscosity ink having a higher viscosity than that of normal ink.

PRACTICAL EXAMPLE

Next, a practical example according to the present embodiment will be described with reference to FIG. 13 to FIG. 16.

Figure 13:
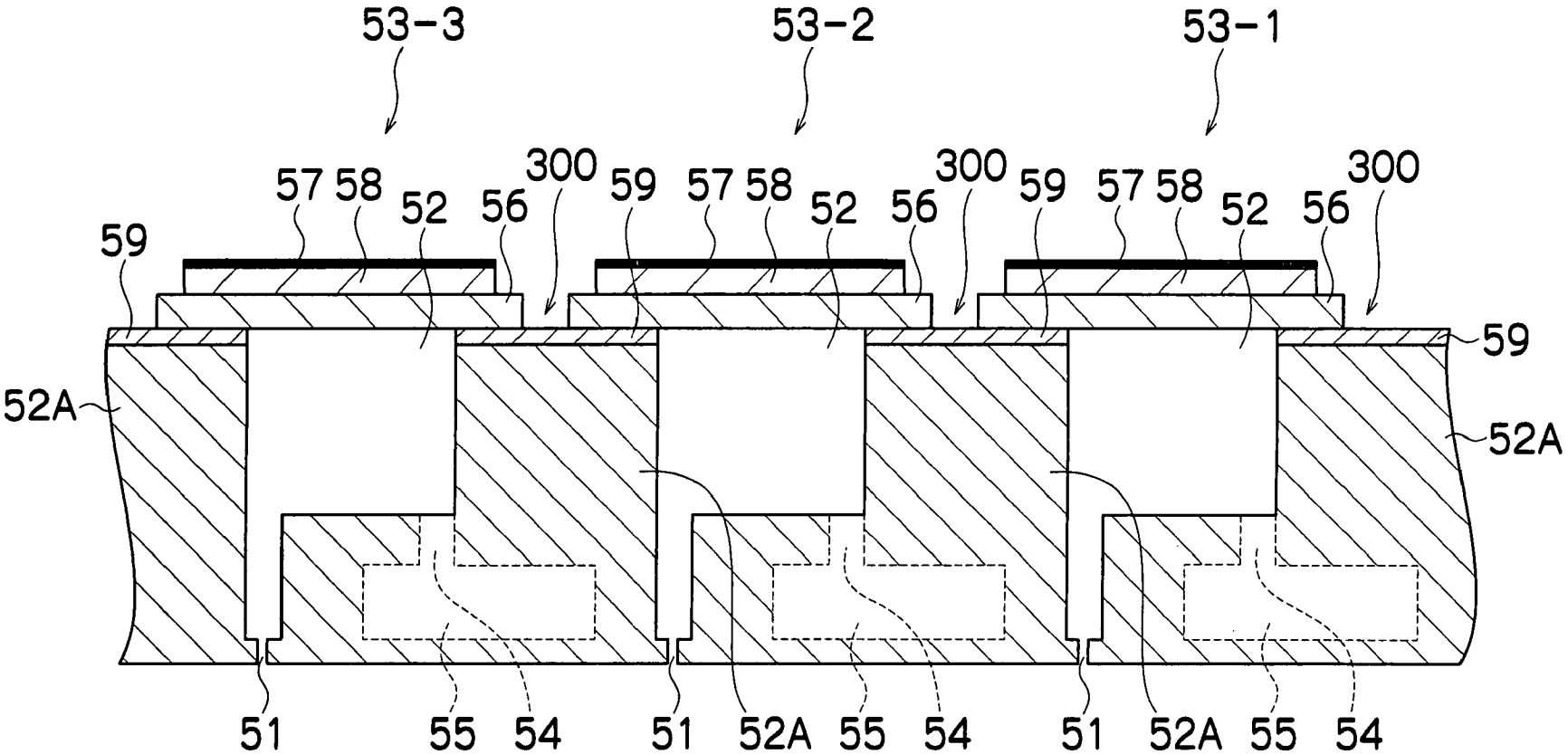
FIG. 13 is a cross-sectional view showing a practical example of an ink chamber unit according to the embodiment of the present invention.

FIG. 13 is a cross-sectional view showing the three-dimensional structure of ink chamber units 53 of a print head 50 according to the present embodiment, indicating three ink chamber units 53-1, 53-2 and 53-3 of the ink chamber units inside the print head 50.

Figure 14:
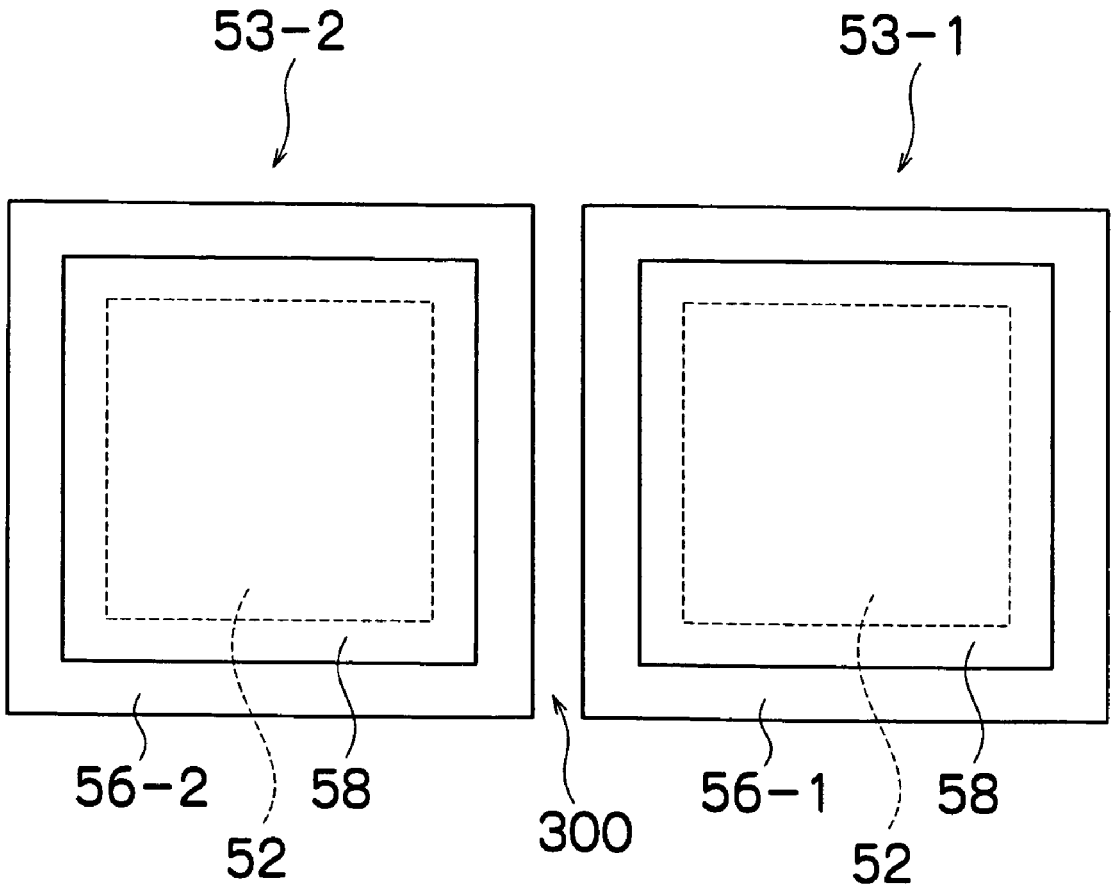
FIG. 14 is a plan view of the ink chamber unit shown in FIG. 12.
Figure 15:
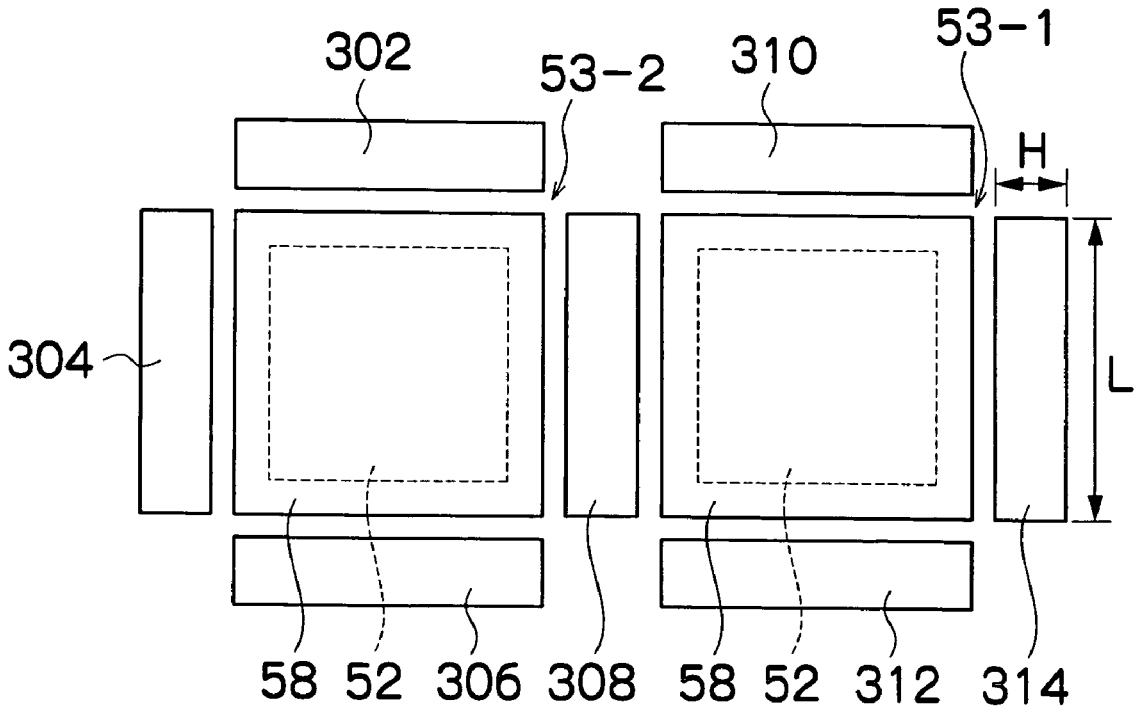
FIG. 15 is a plan view showing a further practical example of an ink chamber unit according to the embodiment of the present invention.

FIG. 14 is a plan view showing the planar structure of two ink chamber units 53-1 and 53-2 of the three ink chamber units shown in FIG. 13, and FIG. 15 shows a further mode of the planar structure of the ink chamber units 53-1 and 53-2 shown in FIG. 14.

As shown in FIG. 13, a diaphragm plate comprises a groove 300 in the sections bonded with the pressure chamber wall 52A by the bonding member 59. The diaphragms 56 are formed on the pressure chambers 52 by dividing the diaphragm plate into a plurality of regions corresponding to the ink chamber units 53-1, 53-2 and 53-3.

When a low-rigidity member (soft member) is used for the bonding member 59 which bonds the pressure chamber wall 52A with the diaphragm 56, a cross-talk is liable to occur between mutually adjacent ink chamber units (pressure chambers). Therefore, by providing the grooves 300 between the diaphragms 56, it is possible to suppress the cross-talk occurring between adjacent ink chamber units.

The depths of the grooves 300 shown in FIG. 13 have substantially the same as the thicknesses of the diaphragms 56, but the depths may also be formed to a smaller than thicknesses of the diaphragms 56. If the depths of the grooves 300 have a smaller than the thicknesses of the diaphragms 56, then the grooves 300 may be provided on the side adjacent to the piezoelectric elements 58, or on the side adjacent to the bonding member 59.

As shown in FIG. 14, a composition may be adopted in which the grooves 300 have the same lengths as the lengths (widths) of the diaphragms 56 (in other words, the grooves 300 pass through the entire lengths (widths) of the diaphragms 56) so that ink chamber units 53-1 and 53-2 have an respective diaphragms 56-1 and 56-2. Also, as shown in FIG. 15, a composition may be adopted in which the grooves (slits) 302 to 314 are shorter than the lengths (widths) of the diaphragms 56.

FIG. 15 shows a mode in which the lengths L of the grooves 302 to 314 are substantially equal to the length of one edge of the piezoelectric elements 58, but the lengths L of the grooves 302 to 314 may be longer or shorter than the length of one edge of the piezoelectric elements 58.

Furthermore, the grooves 302 to 314 may have the same shape, or different shapes. The shape of the grooves 300 to 314 illustrated as a rectangular shape in the present embodiment is not limited to a rectangular shape (square shape), but it may also have another polygonal shape or an elliptical shape.

Moreover, a mode is shown in which each groove 300 comprises one groove, but each groove 300 may also comprise a plurality of grooves. Also, a plurality of the grooves 302 to 314 shown in FIG. 15 may be joined together.

In the present embodiment, a mode is shown in which grooves 300 and other components are disposed in symmetrical positions on either side of the piezoelectric elements 58, but those components may also be disposed in asymmetrical positions.

In addition, the grooves 302 to 314 shown in FIG. 15 are disposed on central positions between adjacent piezoelectric elements 58, but the grooves 302 to 314 may also be disposed on nearer positions in the piezoelectric elements 58.

In this case, when the effect in suppressing cross-talk increases, the widths H of the grooves 302 to 314 are greater, but the bonding force between the pressure chamber wall 52A and the diaphragms 56 decreases. Therefore, it is necessary for determining the widths of the grooves 302 to 314 so that the pressure chamber wall 52A and the diaphragms 56 are bonded together with a prescribed bonding force.

FURTHER PRACTICAL EXAMPLE

Next, a further practical example according to the present embodiment will be described.

Figure 16:
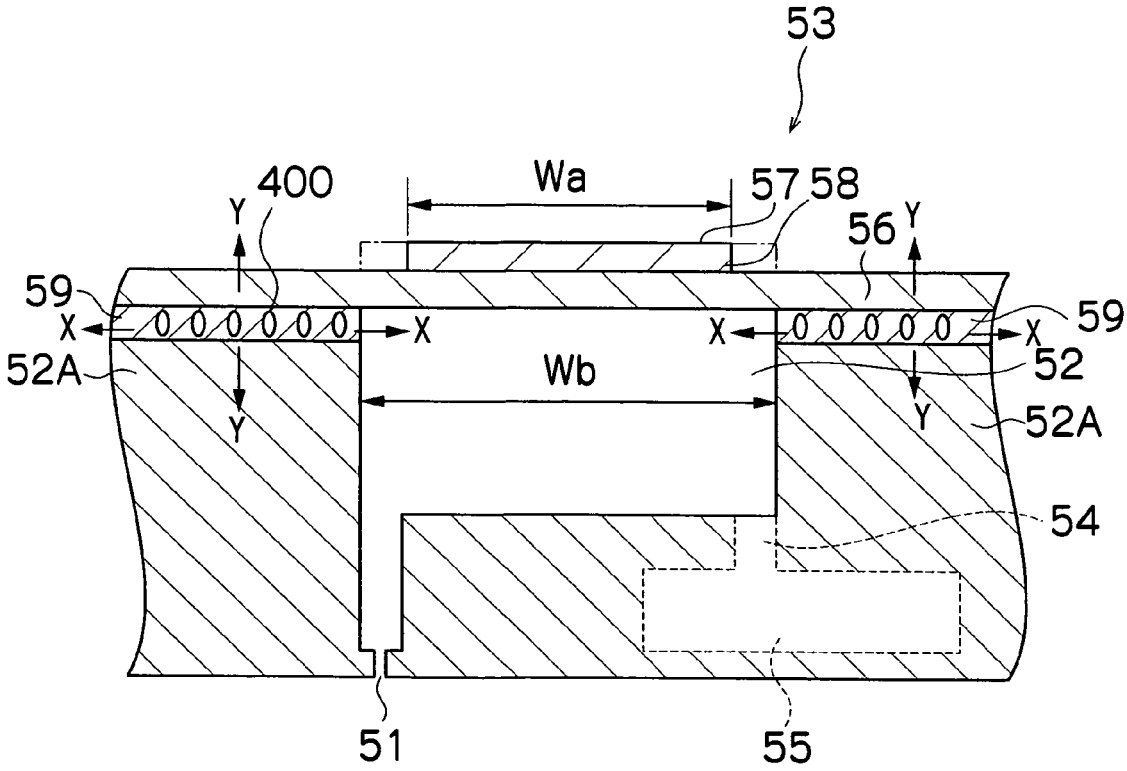
FIG. 16 is a cross-sectional view showing a further practical example of an ink chamber unit according to the embodiment of the present invention.
Figure 17:
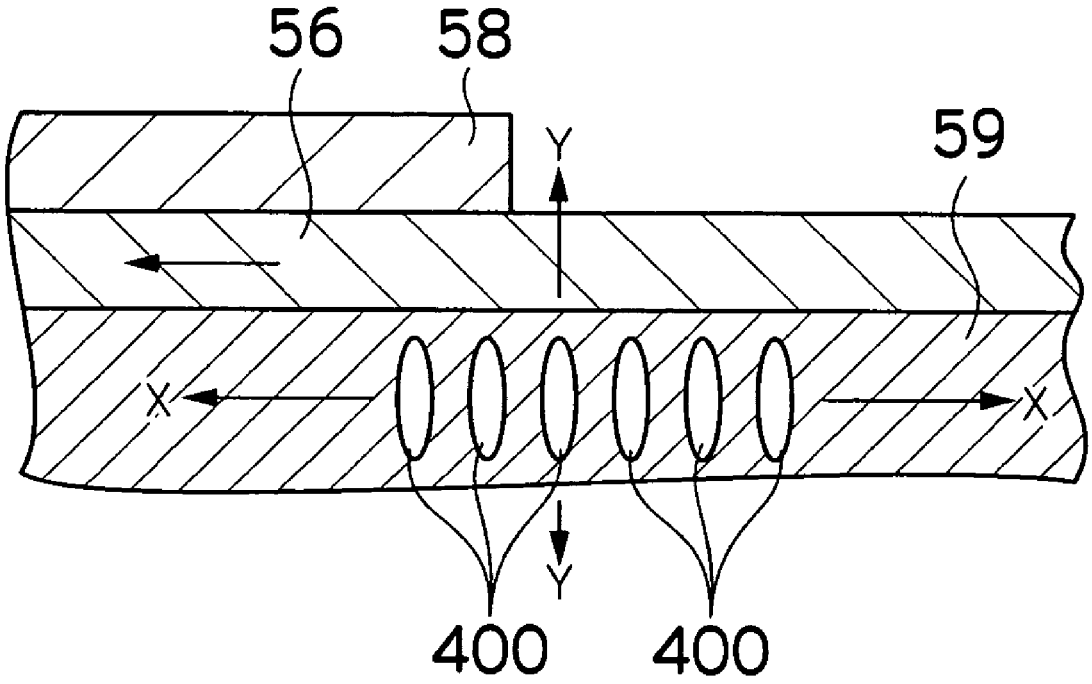
FIG. 17 is an enlarged view of the ink chamber unit shown in FIG. 16.

FIG. 16 is a cross-sectional view showing the further practical example of the print head 50, and FIG. 17 is an enlarged view of the bonding section in FIG. 16 when a pressure chamber wall 52A and a diaphragm 56 are bonded together by means of a bonding member 59.

As shown in FIGS. 16 and 17, the bonding member 59 has a structure in which needle-shaped fillers 400 are aligned in a planar direction (the direction shown as an arrow X in the drawings), which is substantially perpendicular to the thickness direction, thereby imparting the bonding member 59 with anisotropic characteristic so that it has high rigidity in the thickness direction (the direction shown as an arrow Y in the drawings) and has low rigidity in the width direction (planar direction) which is substantially perpendicular to the thickness direction. In other words, as well as functioning as a bonding layer in which the diaphragm 56 and the pressure chamber wall 52A are bonded together, the bonding member 59 also functions as an anisotropic layer which increases rigidity in the thickness direction compared to the rigidity in the width direction.

When a low-rigidity member having lower rigidity than the diaphragm 56 or the pressure chamber wall 52A is used for the bonding member 59, the intrinsic frequency of vibration of the pressure chamber 52 is reduced, and therefore, there is a possibility that it may affect the ejection frequency.

As shown in FIG. 16 and 17, by imparting the anisotropic characteristic to the bonding member 59, the rigidity is made to be high in the thickness direction. Therefore, while the rigidity is made to be low in the width direction, the intrinsic frequency of vibration of the pressure chamber 52 can be kept within a suitable range, and effects on the ejection frequency can be suppressed, thereby serving to increase the displacement volume of the pressure chamber 52.

In the present embodiment, a print head used in an inkjet recording apparatus is described as examples of a liquid ejection head, but the present invention may also be applied to an ejection head used in a liquid ejection apparatus which forms images, or shapes, such as circuit wiring or machining patterns, by ejecting a liquid (such as water, a chemical solution, resist, or processing liquid) onto an ejection receiving medium, such as a wafer, glass substrate, epoxy substrate, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An ejection head, comprising:

a wall member which forms a pressure chamber and has an ejection aperture through which droplets of a liquid are ejected onto an ejection receiving medium, the pressure chamber accommodating the liquid to be ejected from the ejection aperture;

a diaphragm which causes a volume of the pressure chamber to change by performing bending deformation so as to cause the liquid accommodated in the pressure chamber to be ejected from the ejection aperture, the diaphragm forming one face of the pressure chamber;

a piezoelectric element which causes the diaphragm to perform bending deformation in accordance with a drive signal, the piezoelectric element being disposed on the diaphragm; and a bonding member which bonds the diaphragm with the wall member, a diaphragm plate which is divided by a groove structure into a plurality of regions, wherein the diaphragm corresponds to one of the regions and wherein depth of the groove structure determines the position of the groove structure on the diaphragm plate adjacent to the bonding member;

wherein the bonding member has a rigidity lower than that of the wall member of the pressure chamber; and the piezoelectric element has a greater length and a width than an internal effective length and an internal effective width of the pressure chamber thereby to suppress reduction in pressure generated by the piezoelectric element.

2. The ejection head as defined in claim 1, wherein the bonding member comprises an adhesive which bonds the wall member with the diaphragm.

3. The ejection head as defined in claim 1, wherein the bonding member comprises a member having a Young's modulus of no less than 1 MPa and no more than 1 GPa.

4. The ejection head as defined in claim 1, wherein the rigidity of the bonding member is higher in a thickness direction of the bonding member than a planer direction of the bonding member.

5. The ejection head as defined in claim 1, wherein the bonding member has a thickness less than that of the diaphragm.

6. The ejection head as defined in claim 1, wherein the bonding member has a rigidity lower than that of the diaphragm.

7. The ejection head as defined in claim 1, wherein the wall member forms a plurality of pressure chambers that share the diaphragm.

8. The ejection head as defined in claim 1, wherein the diaphragm also serves as an under electrode for the piezoelectric element.

9. The ejection head as defined in claim 1, wherein the bonding member has an opening corresponding to the pressure chamber.

10. The ejection head as defined in claim 1, wherein a thickness of the bonding member is set so that the higher a Young's modulus of the bonding member is, the greater the thickness of the bonding member becomes.

11. The ejection head as defined in claim 1, wherein the bonding member has a Young's modulus of not greater than 100 MPa, when a width Wa of the piezoelectric element and a width Wb of the pressure chamber have a relationship $1<Wa/Wb<1.1$.

12. The ejection head as defined in claim 11, wherein the Young's modulus of the bonding member is not greater than 10 MPa.

13. The ejection head as defined in claim 1, wherein the piezoelectric element distorts in a direction substantially perpendicular to a direction of applied electric field so as to distort the diaphragm in a bending mode.

14. An image forming apparatus, comprising an ejection head which comprises:

a wall member which forms a pressure chamber and has an ejection aperture through which droplets of a liquid are ejected onto an ejection receiving medium, the pressure chamber accommodating the liquid to be ejected from the ejection aperture;

a diaphragm which causes a volume of the pressure chamber to change by performing bending deformation so as to cause the liquid accommodated in the pressure chamber to be ejected from the ejection aperture, the diaphragm forming one face of the pressure chamber;

a diaphragm plate which is divided by a groove structure into a plurality of regions, wherein the diaphragm corresponds to one of the regions and wherein depth of the groove structure determines the position of the groove structure on the diaphragm plate adjacent to the bonding member;

a piezoelectric element which causes the diaphragm to perform bending deformation in accordance with a drive signal, the piezoelectric element being disposed on the diaphragm; and a bonding member which bonds the diaphragm with the wall member, wherein the bonding member has a rigidity lower than that of the wall member of the pressure chamber; and the piezoelectric element has a greater length and a width than an internal effective length and an internal effective width of the pressure chamber thereby to suppress reduction in pressure generated by the piezoelectric element.

15. The ejection head as defined in claim 14, wherein the bonding member has a thickness less than that of the diaphragm.

16. The ejection head as defined in claim 14, wherein the bonding member has a rigidity lower than that of the diaphragm.

17. The ejection head as defined in claim 14, wherein the wall member forms a plurality of pressure chambers that share the diaphragm.

18. The ejection head as defined in claim 14, wherein the diaphragm also serves as an under electrode for the piezoelectric element.

19. The ejection head as defined in claim 14, wherein the bonding member has an opening corresponding to the pressure chamber.

20. The ejection head as defined in claim 14, wherein a thickness of the bonding member is set so that the higher a Young's modulus of the bonding member is, the greater the thickness of the bonding member becomes.

21. The ejection head as defined in claim 14, wherein the bonding member has a Young's modulus of not greater than 100 MPa, when a width Wa of the piezoelectric element and a width Wb of the pressure chamber have a relationship $1<Wa/Wb<1.1$.

22. The ejection head as defined in claim 21, wherein the Young's modulus of the bonding member is not greater than 10 MPa.

23. The ejection head as defined in claim 14, wherein the piezoelectric element distorts in a direction substantially perpendicular to a direction of applied electric field so as to distort the diaphragm in a bending mode.

* * * * *